US007543466B2

(12) United States Patent
Loughlin et al.

(10) Patent No.: US 7,543,466 B2
(45) Date of Patent: Jun. 9, 2009

(54) SECURITY LINK

(75) Inventors: Robert Loughlin, Stanton, NJ (US); John Loughlin, Lebanon, NJ (US)

(73) Assignee: Stanton Concepts Inc., Stanton, NJ (US)

( * ) Notice: Subject to any disclaimer, the term of this patent is extended or adjusted under 35 U.S.C. 154(b) by 0 days.

(21) Appl. No.: 11/231,210

(22) Filed: Sep. 20, 2005

(65) Prior Publication Data

US 2006/0065023 A1 Mar. 30, 2006

Related U.S. Application Data

(60) Provisional application No. 60/611,369, filed on Sep. 20, 2004, provisional application No. 60/651,414, filed on Feb. 9, 2005.

(51) Int. Cl.
*E05B 65/48* (2006.01)

(52) U.S. Cl. ..... 70/8; 70/14; 70/33; 70/54

(58) Field of Classification Search ..... 70/2, 70/18, 51–56, 431, 448, 461, 450–451, DIG. 12, 70/DIG. 32, 6–8, 13, 14, 32, 33, 60
See application file for complete search history.

(56) References Cited

U.S. PATENT DOCUMENTS

| | | | | |
|---|---|---|---|---|
| 62,636 | A | 5/1867 | Kelly | |
| 1,689,437 | A | 10/1928 | Hurd | |
| 1,788,396 | A | 1/1931 | Johnson | |
| 1,792,403 | A * | 2/1931 | Stone | 70/33 |
| 1,814,356 | A | 7/1931 | Wise | |
| 1,845,354 | A | 2/1932 | Soref | |
| 2,104,981 | A | 1/1938 | Falk | |
| 2,825,218 | A * | 3/1958 | O'Brien | 70/7 |
| 3,017,678 | A * | 1/1962 | Christensen | 292/317 |
| 3,664,164 | A * | 5/1972 | Zaidener | 70/14 |
| 3,769,821 | A | 11/1973 | Randel | |
| 3,817,064 | A * | 6/1974 | Sallee | 70/58 |
| 3,835,675 | A | 9/1974 | Lippisch | |
| 3,901,058 | A | 8/1975 | Best | |

(Continued)

OTHER PUBLICATIONS www.tranportsecurity.com/adjustable-lock.asp.

(Continued)

*Primary Examiner*—Patricia L Engle
*Assistant Examiner*—Christopher Boswell
(74) *Attorney, Agent, or Firm*—Diehl Servilla LLC; Glen M. Diehl; Scott S. Servilla

(57) ABSTRACT

A link for connecting at least one securing member, such as chain, with a locking device having a body and a shackle, where the link comprises a base having a through hole adapted to receive the shackle of a locking device and a first securing element associated with the base, the first securing element adapted to receive a first securing member, wherein the shackle of a lock may be inserted through the through hole such that the lock blocks the first securing member from being separated from the securing element. Also disclosed is a system for securing a locking device having a handle hinged to a vertical lockrod, where the system comprises a strap and a link adapted to be installed upon the vertical lockrod and handle such that the handle is prevented from being manipulated in such a manner as to unlock the locking device.

20 Claims, 28 Drawing Sheets

U.S. PATENT DOCUMENTS

| | | | | | |
|---|---|---|---|---|---|
| 3,939,677 | A | | 2/1976 | Drayton | |
| 4,057,982 | A | * | 11/1977 | Drayton | 70/18 |
| 4,102,162 | A | | 7/1978 | Miller | |
| 4,112,716 | A | * | 9/1978 | Wippich | 70/38 C |
| 4,183,235 | A | | 1/1980 | Coralli et al. | |
| 4,269,048 | A | * | 5/1981 | McDorman | 70/13 |
| 4,286,444 | A | * | 9/1981 | Grudich | 70/13 |
| 4,347,720 | A | * | 9/1982 | Kenyon | 70/18 |
| 4,372,136 | A | * | 2/1983 | Mickelson | 70/14 |
| 4,389,862 | A | * | 6/1983 | Hastings | 70/18 |
| 4,694,667 | A | | 9/1987 | Hodge | |
| 4,704,881 | A | * | 11/1987 | Sloop, Sr. | 70/158 |
| 4,754,626 | A | * | 7/1988 | Siegel | 70/32 |
| 4,779,432 | A | | 10/1988 | Frontera-Mariani | |
| 4,956,982 | A | | 9/1990 | Valley | |
| 4,977,763 | A | * | 12/1990 | Sewell | 70/54 |
| 4,998,423 | A | | 3/1991 | Hsu et al. | |
| 5,070,712 | A | * | 12/1991 | Fox | 70/18 |
| 5,145,222 | A | | 9/1992 | Meyer | |
| 5,146,771 | A | | 9/1992 | Loughlin | |
| 5,219,384 | A | * | 6/1993 | Elsfelder et al. | 70/18 |
| 5,284,036 | A | * | 2/1994 | Rosenbaum | 70/56 |
| D351,984 | S | | 11/1994 | Victor | |
| 5,419,165 | A | * | 5/1995 | Perkins | 70/19 |
| 5,442,941 | A | | 8/1995 | Kahonen et al. | |
| 5,469,722 | A | * | 11/1995 | Ellefsen | 70/56 |
| 5,481,888 | A | * | 1/1996 | Perry | 70/18 |
| 5,775,747 | A | | 7/1998 | Navarsky | |
| 5,953,941 | A | | 9/1999 | Freund | |
| 5,956,980 | A | | 9/1999 | Jenkins, Jr. | |
| 6,012,739 | A | | 1/2000 | Weiss et al. | |
| 6,244,614 | B1 | | 6/2001 | Bonvillain et al. | |
| 6,263,709 | B1 | * | 7/2001 | Kemery et al. | 70/18 |
| 6,467,317 | B1 | | 10/2002 | Hillabush et al. | |
| 6,755,054 | B2 | * | 6/2004 | Burmesch et al. | 70/49 |
| 6,766,671 | B2 | | 7/2004 | Haczynski et al. | |
| 6,823,701 | B1 | | 11/2004 | Gogel | |
| 6,829,916 | B1 | | 12/2004 | Devecki | |
| 6,834,896 | B2 | | 12/2004 | Smith | |
| 6,915,670 | B2 | | 7/2005 | Gogel | |
| 6,925,842 | B1 | | 8/2005 | Hillabush et al. | |
| 6,983,629 | B1 | | 1/2006 | Gogel | |
| 7,047,774 | B1 | * | 5/2006 | Gogel | 70/32 |
| 2005/0099018 | A1 | | 5/2005 | Witchey | |

OTHER PUBLICATIONS www.saundersonsecurity.co.uk/itmidxbullcontainerlock.shtml.
www.sealock.com/sealock_model_ru2004.html, 2 pages.
www.sealock.com/the_sealock_solution.html, 2 pages.
Navalock MK-IIIA and Navablock for Trailer Security, www.cgmsecuritysolutions.com/sw/swchannel/productcatalogcf_v2/internet/model.asp/ProductMast, 4 pages.
Ranger Deadbolt, Advertisement for Puckbolt: The Ultimate to Keep Doors Tightly Closed.
Transport Security Inc., 'The Enforcer Product Line' catalog, 6 pages.
www.rangerdeadbolt.com/TrailerDoors.html, 3 pages.
Pictures of Ranger Deadbolt, 4 pages.
"PCT International Search Report—PCT/US05/33533", (Apr. 28, 2006),2 pgs.
"PCT Written Opinion—PCT/US05/33533", (Apr. 28, 2006),7 pages.

* cited by examiner

SECURITY LINK

CROSS-REFERENCE TO RELATED APPLICATIONS

This application claims the benefit of the filing date of U.S. Provisional Patent Application No. 60/611,369 filed Sep. 20, 2004, and U.S. Provisional Patent Application No. 60/651,414, filed Feb. 9, 2005, the disclosures of which are hereby incorporated herein by reference as if fully disclosed herein.

BACKGROUND OF THE INVENTION

The present invention relates in general to padlock enhancement systems. Such systems may be utilized to secure objects that may conventionally be secured by a padlock, but include features to compensate for inherent weaknesses in the conventional padlock design.

The systems included in the present application may be utilized for securing objects such as chain, cable, or other flexible or non-flexible elements, or conventional barn-door style intermodal container or trailer locking systems with shackle padlocks of various configurations. Such attachments may accept links of chain or similar engaging elements to provide relatively great resistance to forced attack while maintaining ease of use, flexibility in application, and cost effectiveness. The attachments also provide provisions for association with conventional barn-door style locking systems for added security.

It is well known that the "weak link" in a chain or cable-lock system is often the lock itself, and therefore the lock is a common attack point. For example, in the most basic system, a U-shackle type padlock may secure a length of chain. Depending on the padlock used, the chain is often much stronger than the lock itself. Thus, the lock may be attacked either by applying a torque to the shackle, or simply applying a tension force to the shackle by pulling on the chain. The present invention provides means to combat these common attack methods by providing novel attachment means for a lock to attach to a locking system. In accordance with certain aspects of the present invention, and to further provide security, the shackle of the lock may be completely hidden, such that attack upon the shackle is extremely difficult.

In barn-door style locking systems, it is well known that common attack points are the rivets that secure the locking system to the doors, or the rivets that secure the pivoting handle to the vertical rod. In accordance with certain aspects of the present invention, a link system may be employed to protect these vulnerable areas, in addition to protecting the lock itself.

Additionally the present invention permits the exploitation of the following advantages:

(A) Hockey Puck Style Locks: The conventional well known "shackleless" cylindrical padlocks with hidden straight shackles generically referred to as hockey puck locks are in common use today. Hockey puck locks are shown in U.S. Pat No. 3,901,058 issued to Best, U.S. Pat. No. 3,769,821 issued to Randel, and U.S. Pat. No. 6,766,671 issued to Haczynski, et al. These examples each provide a recess within the lock to accept a specific attachment, hasp, or staple of a generic hasp of appropriate dimension to fit and provide for the engagement of the straight shackle which passes through the recess. The resulting assembly provides a hidden shackle and hasp or attachment protected from forced attack by the surrounding body of the padlock.

Heretofore, such hockey puck style locks have typically been employed directly to locking systems of doors, such as doors of cargo vans. Aspects of the present invention provide means for the engagement of chain, cable, or chain like elements by means of a novel attachment device, which engages within the recess of the cylindrical padlock body. The hidden straight shackle of the padlock may then pass through the hole provided in the device to result in the secure assembly of chain, attachment, and padlock. Such an assembly can broaden the use of conventional hockey puck style locks, and can provide for security levels heretofore unachievable by convention locking systems.

Aspects of the present invention may also provide for a shielding element to protect the vulnerable bottom of the hockey puck style padlock. These aspects may include facility for mounting the novel attachment device to an object or structure to provide a system of security including padlock, chain (or other flexible or non-flexible element), item to be secured, and a fixed structure.

(B) Straight Shackle Style Padlocks: Straight shackle padlocks in which the shackle is not hidden and is readily visible are also in use today. Locks of this type are shown in U.S. Pat. No. 2,104,981 issued to Falk, U.S. Pat. No. 4,183,235 issued to Coralli, or U.S. Pat. No. 5,442,941 issued to Kahonen. These examples also offer a recess to accept the attachment for chain, cable, or chain like flexible elements that would be engaged by the straight shackle to provide the secure assembly of attachment, chain and padlock. Additionally the well-known ring shackle, or circular shackle, padlocks generically referred to as disc padlocks provide features similar to the straight shackle padlocks described above. Locks of this sort are shown in U.S. Pat. No. 62,636 issued to Kelly, U.S. Pat. No. 1,788,396 issued to Johnson, and U.S. Pat. No. 4,998,423 issued to Hsu. These examples also accept attachments contemplated by the present invention.

Aspects of the present invention provide for the engagement of chain, cable, or other flexible or non-flexible elements with a specific attachment device, which engages within the exposed recess of the padlock and provides sufficient structure to protect both the shackle and the elements of the attachment device from forced attack.

(C) The conventional well-known U-shackle padlocks, which are provided with a shield or shroud, are in limited use today. Locks of this sort are shown in U.S. Pat. No. 3,835,675 issued to Lippisch, U.S. Pat. No. 4,102,162 issued to Miller, or U.S. Pat. No. 5,146,771 issued to Loughlin, an inventor herein. These examples also offer a recess to accept the attachment for chain, cable, or chain like elements that would be engaged by a protected U-shackle to provide the secure assembly of attachment, chain and padlock. The most common U-shackle padlocks may also accept the attachment contemplated by the present invention when configured with the appropriate and compatible dimensions.

Aspects of the present invention provide for the engagement of chain, cable or other flexible or non-flexible elements with a specific attachment device, which engages within the recess of the shrouded padlock or conventional padlock and provides sufficient structure to protect both the shackle and the elements of the attachment, chain and padlock.

These and other aspects of the present invention will be discussed more fully below. However, it is noted that it would be advantageous to provide a chain attachment for shackle padlocks which aids in securing a chain/cable-type lock system in a manner not heretofore envisioned. It would also be advantageous to provide a similar system for use with barn-door style container/trailer doors. Each of these systems provide for security levels heretofore unimagined.

SUMMARY OF THE INVENTION

The chain attachment for shackle padlocks of the present invention is designed to overcome the deficiencies of the prior art. Several objectives and advantages of this invention follow from the novel method by which the attachment mechanism is utilized in conjunction with a chain/cable system.

In general, the security link of the present invention is designed to work in conjunction with a shackle lock, such as a straight shackle lock, hockey puck lock, padlock, or cylinder lock, such that securing elements of the link, typically posts or ears, secure securing members, such as chain, cable, or other flexible or non-flexible securing members, in a manner heretofore unrealized. In this regard, the link is designed to withstand potential forces exerted on the securing member, rather than the lock, as is known.

In other aspects of the invention, the novel link, in conjunction with a strap system, may be added to security systems of the type having a vertical lockrod and hinged handle, typically found on container and truck doors.

More specifically, in accordance with one aspect of the present invention, the invention may include a link for connecting at least one securing member with a locking device having a body and a shackle, the link comprising a base having a through hole adapted to receive the shackle of a locking device, and a first securing element associated with the base, the first securing element being adapted to receive a first securing member, wherein the through hole of the base and the first securing element are arranged so that when the shackle of the locking device is inserted through the through hole of the base, the locking device is arranged to block the first securing member from being separated from the securing element.

The link may further comprise a second securing element associated with the base, the second securing element adapted to receive a second securing member, wherein the through hole of the base and the second securing element are arranged so that when the shackle of the locking device is inserted through the through hole of the base, the locking device is arranged to block the second securing member from being separated from the second securing element.

The securing member may be one of a chain or a cable.

The securing element may be one of an ear or a post.

Where the securing element is an ear, the ear may be one of C-shaped, J-shaped, or U-shaped. The ear may include an end adapted to be located in close proximity to the body of the locking device when the shackle of the locking device is inserted through the through hole to prevent the securing member from being unsecured through a gap created between the securing element and the body of the locking device.

Where the securing element is a post, the locking device may be adapted to rest atop a portion of the post to block the securing member from being unsecured when the shackle of the locking device is inserted through the through hole.

The link may further comprise a channel adapted to receive a second securing member. The first and second securing members may be portions of a single securing member. The channel may include a ratcheting device adapted to permit the second securing member to move through the channel in only one direction.

The link may include additional features, such as an anti-rotation step, apertures to permit mounting thereof, a raised lip partially surrounding the lock, a cutout in lip permitting use of the keyed cylinder of the lock, or a generally circular shape in registration with a lock. In addition, the locking device may be a hockey puck lock. Where the locking device is not a hockey puck lock, the link may also include a plate adapted to permit use of a shackle lock, such as a padlock or straight shackle lock. The plate may be thick such as portions of the plate block the securing member from being freed of the link, or may be thin in the case where the plate rests on the securing member, yet may still block the securing member from being freed from the link. The plate may include an aperture through which the post may penetrate. Finally, the plate may also include an anti-rotation step which may be placed in registration with the anti-rotation step of the link.

The ears or parts of the link may also be provided with magnets to help temporarily retain ferrous metal securing elements during installation.

In accordance with further aspects of the present invention, there is disclosed a device adapted to connect a first securing member to a second securing member, where the device comprises a body having an aperture and first and second securing elements, the aperture adapted to receive the shackle of a lock and the first and second securing elements adapted to receive the first and second securing members. The first securing element may be inserted through the first securing member, the second securing element may be inserted through the second securing member, and the shackle of the lock may be inserted through the aperture such that the lock inhibits the securing members from being disassociated with the first and second securing elements.

The first securing member may be one of a chain link or the looped end of a cable.

The link may further comprise a second aperture adapted to receive the shackle of a lock, wherein the second aperture permits use of locks with shackles of a size different from the size of the shackle of the lock adapted to be inserted through the first aperture.

The link may include additional features. For example, the link may be generally triangular in shape. In such configuration, an aperture may be configured in one corner with the first and second securing elements in each of the other corners. The securing elements may be C-shaped, J-shaped, or the like. The link may be made from ferrous or non-ferrous metals or alloys, and may be coated for protection, such as from outdoor elements.

In accordance with still further aspects of the invention, a system for securing a locking device having a handle hinged to a vertical lockrod may comprise a strap having a first end and a second end, the first end may be adapted to associate with the vertical lockrod of a locking device such that the strap may rotate around the first end, the second end having an aperture therethrough, a link having a passage therethrough, the link adapted to be slid onto the handle of the locking device such that the handle passes through the passage, the link having a raised portion, the raised portion having a through hole, the raised portion adapted to extend through the aperture of the strap such that a lock may be secured through the through hole of the raised portion to prevent the handle from being manipulated in such a manner as to unlock the locking device.

Where the device further includes a hasp adapted to bind the handle, the strap may further comprise an aperture permitting the hasp to extend therethrough for use.

The device may include additional features. For example, the strap may include features, such as extension features, to cover the rivets securing either or both of the hasp or the hinge. The first end of the strap may comprise at least one hook. The at least one hook may be U-shaped to substantially surround the vertical rod. The strap may be configured in non-planar sections to fit closely with the handle. Finally, the apertures at the second end of the strap may be crescent shaped, to accept the interrupted raised lip of the link.

In accordance with additional aspects of the present invention, a system is disclosed for providing additional protection to a locking device of the type having a handle hinged to a vertical lockrod and a hasp adapted to bind the handle when in a locked position, where the system comprises a strap having a first end adapted to wrap at least partially around the vertical lockrod and a second end adapted to be placed adjacent to the handle when the handle is in the locked position, the second end including a notch, a link comprising a base having an aperture, the aperture adapted to permit entry of the handle and the second end of the strap, the link further comprising a post having a post through hole, the post through hole being adapted to accept the shackle of a lock, a plate configured to fit against the link, the plate comprising a plate with a plate through hole, the plate through hole configured to register with the post through hole, and a pin, the pin adapted to enter the notch when the plate through hole is in registration with the post through hole such that the interference between the pin and the notch prevents the link from being slid and removed from the handle and the strap.

The link may further comprise a spring adapted to bias the plate toward a position wherein the pin is not within the notch.

The system may include additional features. For example, the springs may be permanently attached to the link. The strap may include features, such as extension features, to cover the rivets securing either or both of the hasp or the hinge. The first end of the strap may comprise at least one hook. The at least one hook may be U-shaped to substantially surround the vertical rod. The strap may be configured in non-planar sections to fit closely with the handle.

In accordance with yet an additional aspect of the present invention, a locking device may comprise a link having a first hook and a post extending therefrom, the first hook adapted to be secured around a first object and the post adapted to accept a lock, a second hook having a straight portion with at least one aperture, the second hook adapted to be secured around a second object with the straight portion placed over the post, whereby the post may accept a lock such that the first object and the second object may be secured together.

The at least one aperture may be a plurality of apertures and the length of the locking device may be adjusted by positioning the second hook over the post through different apertures.

The locking device may include additional features, such as being of a thickness to fit between the vertical lockrod and door of a typical container locking system.

In accordance with an additional aspect of the present invention, where a link system for connecting at least one securing member with a locking device having a body and a shackle is disclosed, the link may comprise a base having a post with a through hole adapted to receive the shackle of a locking device, a plate adapted to fit against the base, the plate comprising an aperture through which the post of the base may be inserted, a first securing element associated with the base, the first securing element adapted to receive a first securing member, wherein the base and the plate are constructed and arranged so that the shackle of a lock may be inserted through the through hole of the post after the plate is fitted against the link such that the plate blocks the first securing member from being separated from the securing element and the shackle blocks the plate from being released from against the base.

The link system may therefore be adapted for use with a U-shackle padlock, straight shackle padlock, circular shackle padlock, or the like.

In each of these aspects, various features have been disclosed. It will be appreciated that many of the features are interchangeable between the various aspects, and that they may be utilized in various combinations to achieve the inventive results. Accordingly, various combinations of disclosed features may be included in the above aspects of the invention, or additional aspects not specifically described herein, but which are included in this disclosure.

BRIEF DESCRIPTION OF THE DRAWINGS

The subject matter regarded as the invention is particularly pointed out and distinctly claimed in the concluding portion of the specification. The invention, however, both as to organization and method of operation, together with features, objects, and advantages thereof will be or become apparent to one with skill in the art upon reference to the following detailed description when read with the accompanying drawings. It is intended that any additional organizations, methods of operation, features, objects or advantages ascertained by one skilled in the art be included within this description, be within the scope of the present invention, and be protected by the accompanying claims.

In regard to the drawings,

FIG. 15 depicts a perspective view of a conventional locking assembly used on barn-style doors of intermodal containers, trailers, and the like;

DETAILED DESCRIPTION

Figure 1:
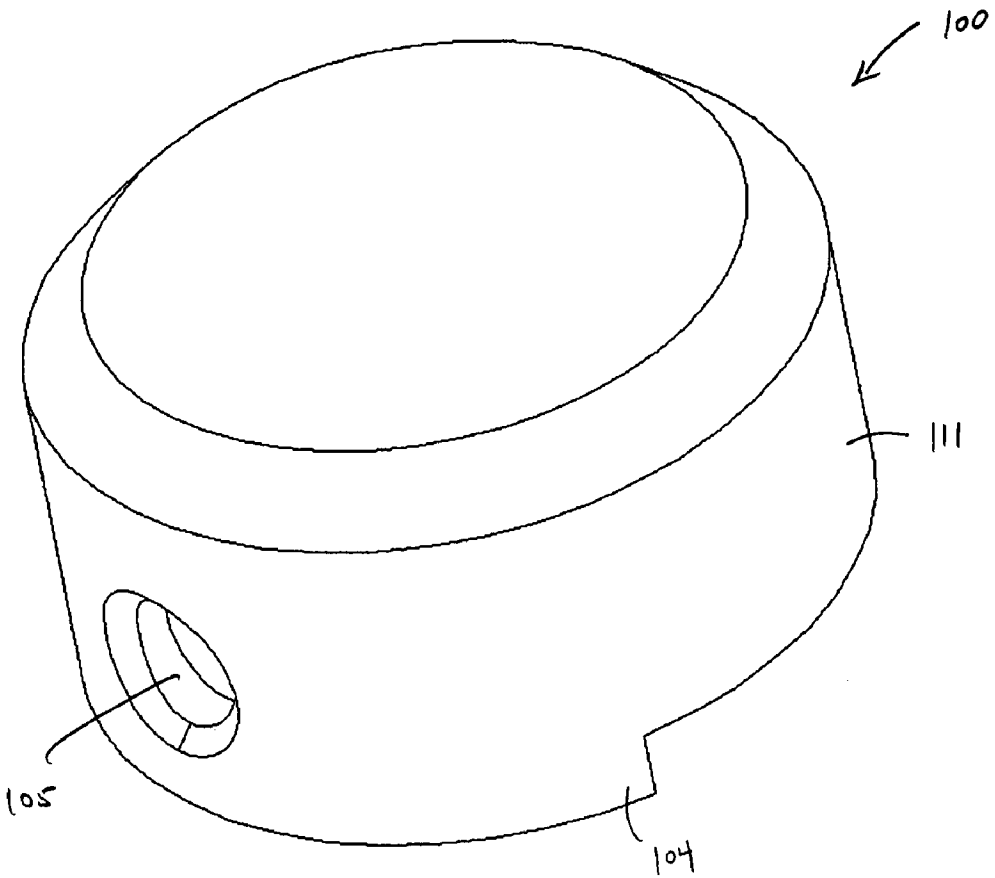
FIG. 1 (prior art)
FIG. 1 depicts a top perspective view of a conventional hockey puck lock.

The following describes the preferred embodiments of the multiple function lock in accordance with the present invention. In describing the embodiments illustrated in the drawings, specific terminology will be used for the sake of clarity. However, the invention is not intended to be limited to the specific terms so selected, and it is to be understood that each specific term includes all technical equivalents that operate in a similar manner to accomplish a similar purpose.

It will become evident to one skilled in the art that several objectives and advantages of this invention follow from the novel aspects of the present invention by which the traditional security functions are achieved using multiple security elements in combination.

Throughout this disclosure, the term shackle shall be construed broadly to include the portion of a lock which extends from the body and which is typically moveable to engage with securing members such as hasps, chain, cable or the like.

FIG. 1 depicts a perspective view of a conventional cylindrical, hidden shackle pad lock, commonly referred to as a hockey puck lock 100. The hockey puck style lock 100 includes an outer casing 111 which is shaped in a manner similar to that of a hockey puck, thus giving the lock its name.

Figure 2:
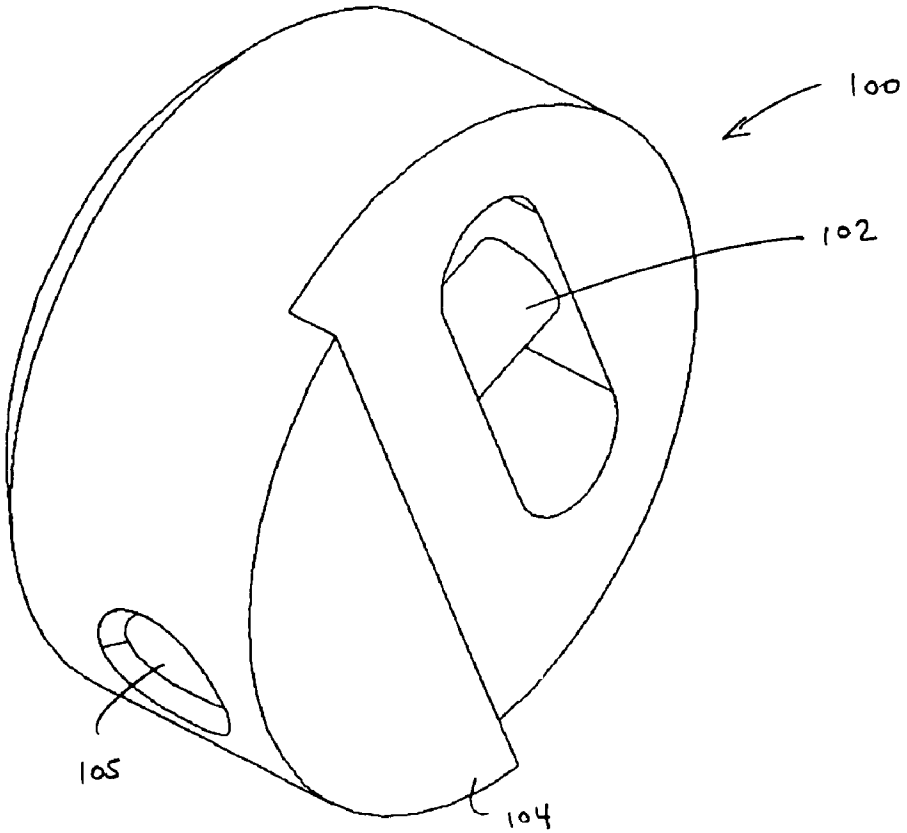
FIG. 2 (PRIOR ART)
FIG. 2 depicts a bottom perspective view of the conventional hockey puck lock of FIG. 1.

Shown in FIG. 2 is a bottom perspective view of a conventional hockey puck lock 100. The drawing figure shows shackle 102 and anti-torque step 104. The step 104 is typically part of the standard form factor of a conventional hockey puck lock 100, and is a built-up shoulder area formed as part of outer casing 111. Other embodiments may have a flat bottom. However, if provided, the step 104 may cooperate with associated appurtenances to prevent the hockey puck lock 100 from rotating. This reduces the ability of a malfeasant from placing a torque or twisting force on the shackle 102 in an attempt to compromise the shackle and thus the security of the lock 100. Even with the step 104 in place, the bottom of the conventional hockey puck lock 100 is still generally vulnerable to attack, particularly where the shackle 102 is exposed.

The hockey puck lock 100 utilized in the present invention may be operated in the conventional manner. For example, the shackle 102 may be manipulated by a keyed cylinder 105, as is known in the industry.

Figure 3:
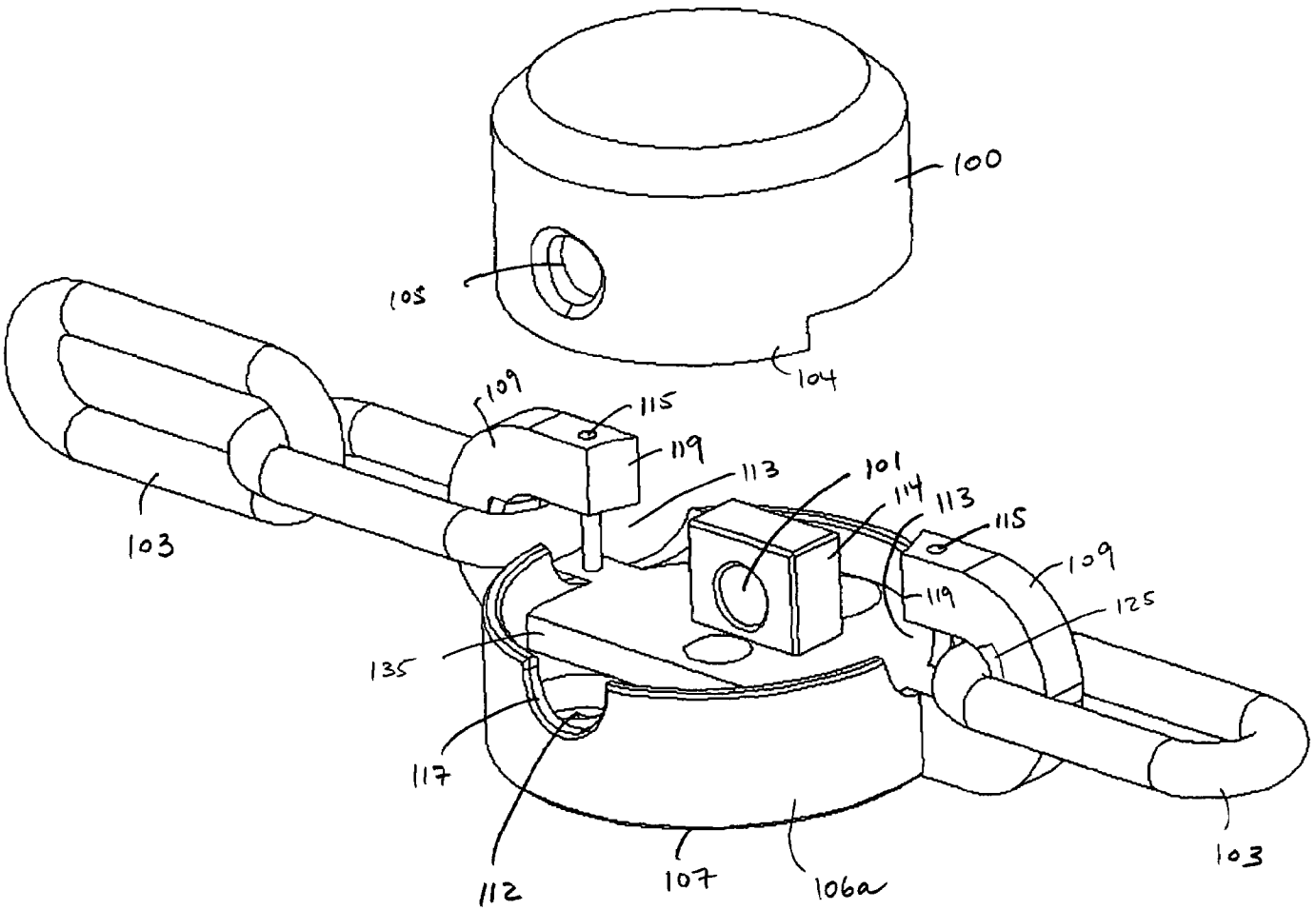
FIG. 3 depicts a perspective view of a link system in accordance with certain embodiments of the present invention, with the hockey puck lock detached.

FIG. 3 depicts a partially exploded perspective view of a link 106a in accordance with certain aspects of the present invention along with a hockey puck lock 100 and chain 103. In accordance with the aspects of the invention depicted in FIG. 3, a link 106a may be compatible with flexible or non-flexible securing devices, such as either chain 103 or cable having end loops. Chain 103 is shown in FIG. 3. For ease of reference, chain 103 will generally be referred to throughout the various aspects of this disclosure. However, it is to be understood that other securing devices may also be utilized, flexible or not.

The link 106*a* may include a base 107 having a pair of extension members, here shown as protruding ears 109. The protruding ears are preferably C-shaped, with openings 113. In other embodiments, the extension members may be U-shaped or J-shaped. The base 107 and ears 109 of the link 106*a* may be configured such that a chain 103 may be placed over and around the ears 109, through opening 113, such that the ears prevent the chain from being pulled from the link. This arrangement is shown in FIG. 3.

Figure 4:
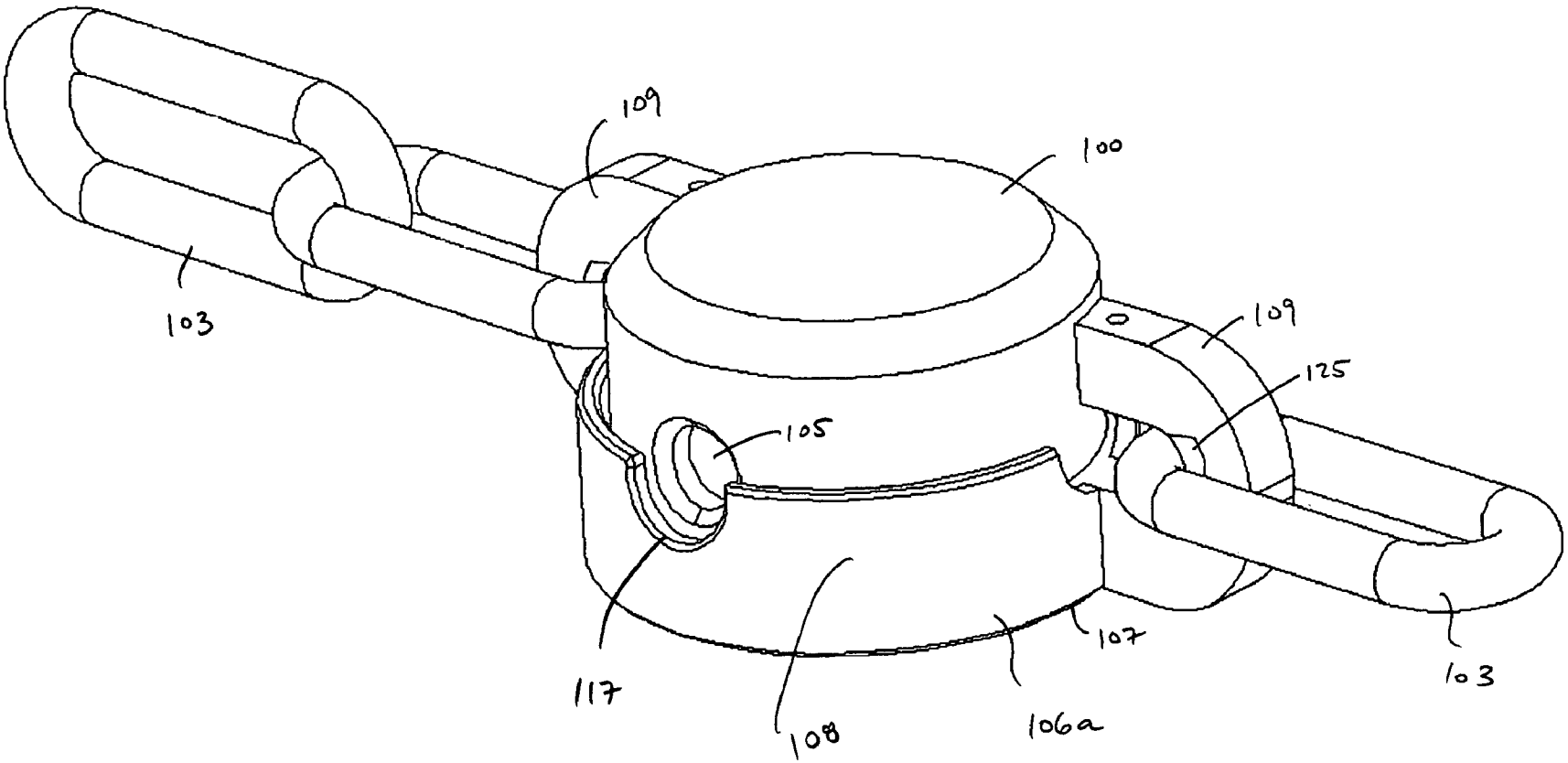
FIG. 4 depicts a perspective view of the link system of claim 3, with the hockey puck lock attached.

After being placed in such an arrangement, the chain 103 may be followed by a conventional hockey puck lock 100, such that the hockey puck lock 100 blocks the chain from being removed from the ears 109 through the opening 113 without prior removal of the hockey puck lock, such as shown in FIG. 4. It will be appreciated that the ears 109 are configured such that the space between the free end 119 of the ears is relatively close to the outer casing 111 of lock 100, or at least close enough that chain 103 may not fit therebetween. In other embodiments, the ears 109 may include pins or posts 115 which may either be installed permanently to secure the chain 103, or may be removable. Typically, only one pin 115 will be permanently installed and the opposite ear 109 will be provided without a pin, such that chain 103 may be attached and detached from the pinless ear. Even if the pins or posts 115 are installed permanently, the hockey puck lock 100 serves to provide an additional level of protection for the link system. The ears 109 may also include embedded magnets 125 to help retain ferrous metal securing devices, such as chain 103, during installation thereof.

Referring back to FIG. 3, it will be appreciated that when installed upon the link 106*a,* the shackle 102 (FIG. 2) of the hockey puck lock 100 engages a through channel 101 extending through the pin or post 114 protruding from the link 106*a,* to secure the hockey puck lock to the link in the conventional manner.

Features of the link 106*a* in accordance with this embodiment may include a raised lip 108 extending from the base 107 to prevent a prying or wedging attack when the conventional hockey puck lock 100 is in place. The lip 108 may be notched with a cutout 117 to allow access to the keyed cylinder 105 of the hockey puck lock 100. Mounting holes 112 may be provided in the bottom of the link 106*a* to allow mounting of the link 106*a* to a surface using carriage bolts or the like. A center mounting hole 112 may be provided to allow the link 106*a* to be mounted to a surface while also permitting the link to be rotated. The link 106*a* may also be welded to a surface or used un-mounted, so as to be freely transported.

The free end 119 of the ears 109 may be contoured to minimize the gap between the free end of the ears and the lock body 100 when the lock is in place, such as shown in FIG. 4. As previously discussed, the ears 109 may also include a feature, such as a simple post or pin 114, which allows one or both ends of the chain or cable to be retained permanently.

In addition, the link 106*a* may include an anti-rotation step 135 within the raised lip 108. The anti-rotation step 135 may be configured to mate with the step 104 of hockey puck lock 100, such that the lock may not be rotated when installed.

The link 106*a* may be fabricated by machining, casting, welding, molding, forging, etc. Materials utilized may be suitable ferrous or non-ferrous metallic alloys or suitable non-metallic materials, such as plastics. Preferably, the link 106*a* is formed from material which is sufficiently durable to withstand forced attack, while also being capable of long-term external exposure.

It will be appreciated that when the chain 103 is pulled, such as during a forced attack or other tension inducing activity, the loads, or forces applied, to the chain will be transferred through the link 106*a*, and particularly the ears 109. The loads will not be transferred to the shackle 102 of the hockey puck lock 100 as would occur if the hockey puck lock was used without the inventive link 106*a*. This feature enables security levels greater than would be capable if the shackle 102 was required to withstand the load, and is utilized in further embodiments of the invention, as will be discussed. In this regard, the strength of the link 106*a* and ears 109 may be much greater than that of the lock 100, while still being very cost-effective and simple to manufacture.

Figure 5:
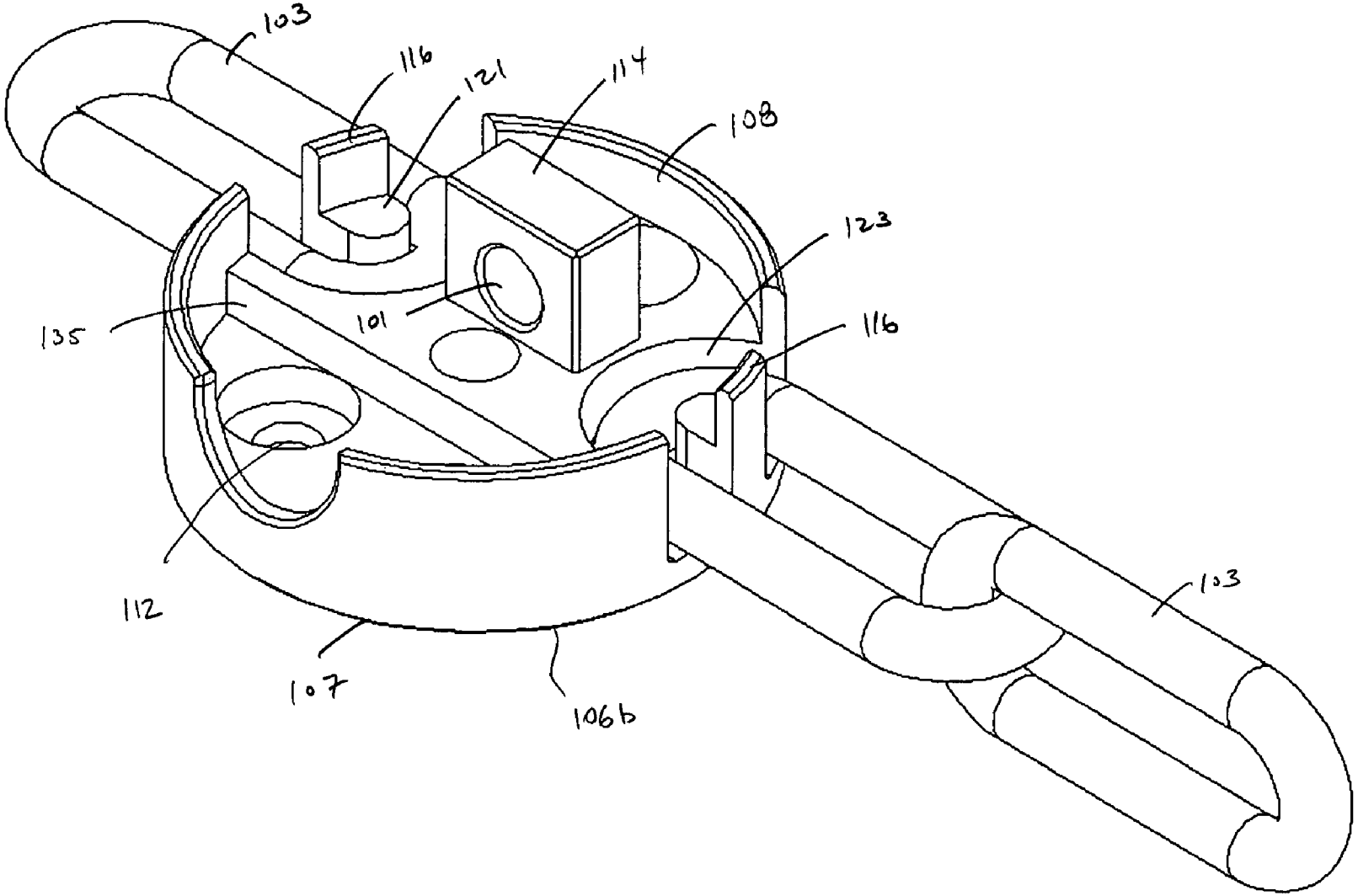
FIG. 5 depicts a perspective view of a link system in accordance with further aspects of the present invention.

FIG. 5 depicts a perspective view of a link 106b in accordance with further aspects of the present invention with a chain 103 attached, but without a hockey puck lock 100 in place. The link 106b depicted in FIG. 5 includes posts 116 formed from portions of the raised lip 108 of the base 107 rather than ears 109. The posts 116 permit the end or ends of a chain 103 to be assembled onto the link 106*b* by being placed over the posts 116 and into a recess 123. The posts 116 include a stepped portion 121 which is above the level of the recess 123. A hockey puck lock 100 may be placed upon the stepped portion 121 when installed. In this regard, securing of the shackle 102 of the hockey puck lock 100 through the through channel 101 of post 114 places the casing 111 of the hockey puck lock over the chain 103, to secure the chain to the link 106*b*. Unless the hockey puck lock 100 is removed, the chain 103 cannot be released from the link 106*b*.

Although not shown in association with this particular aspect of the invention, it is noted that the recess 123 permits use of a feature that may retain one or both ends of the chain 103 when the hockey puck lock 100 is not in place. Such a feature, not shown, may be a simple screw threaded into the link 106*b* adjacent to the recess 123 such that the head of the screw may be driven against chain 103 to block the chain from being removed from the recess 123. Other mechanisms, such as rotating blocking gates, or embedded magnets may also be utilized.

It is believed that the link 106*b* shown in FIG. 5 is easier and more cost effective to manufacture than the link 106*a* shown in FIGS. 3 and 4. It is also believed that the link 106*b* shown in FIG. 5 may be more secure than the previous link 106*a* because the ears 109 of the previous link 106*a* may be vulnerable to attack, particularly through prying away of the ears. It is much more difficult to forcibly attack the posts 116 of the link 106*b* shown in FIG. 5, as there is less area for a malfeasant to attack. Even if a malfeasant were capable of prying a post 116 away from its generally vertical orientation, the chain 103 would not readily lift from the post, as the hockey puck lock 100 would still retain the chain. Rather, the entire hockey puck lock 100 would have to be removed or the post 116 severely compromised.

Figure 6:
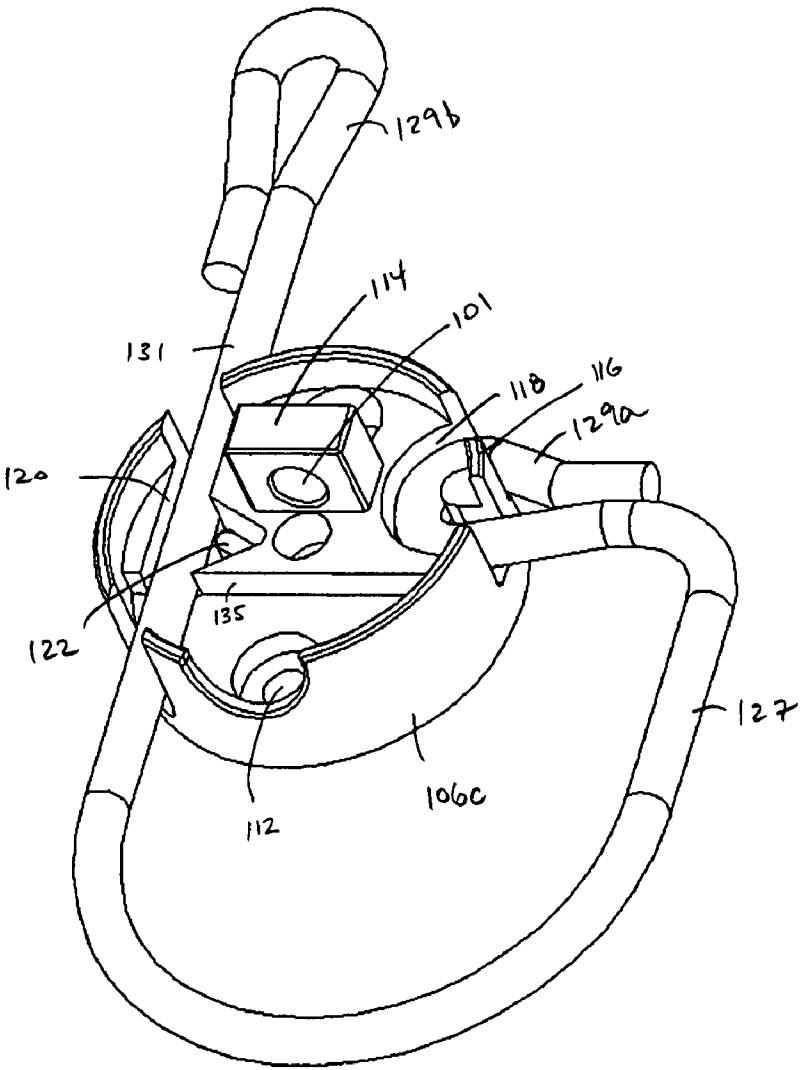
FIG. 6 depicts a perspective view of a link system in accordance with yet another aspect of the present invention.

In accordance with yet another aspect of the present invention, as shown in FIG. 6, a link 106c may build on the teachings of the previous link 106*b*. In this regard, the link 106*c* may include a recess (here identified as arched recess 118) and a post 116. This portion of the link 106*c* may secure one end of a cable 127 that includes a looped end 129*a* forming a shape much like a chain's end. Of course, this arrangement may also secure other mechanisms such as simple chain.

The link 106*c* may also be compatible at its other side with a straight portion 131 of cable 127. In this regard, the link 106*c* may include a straight channel 120 in which the straight portion 131 of the cable 127 may lie. The straight channel 120 may be sized to just accept the diameter of the cable 127, such that the looped end 129*b* opposite the post 116 and looped end 129*a* may not pass therethrough. It will be appreciated that other features other than a looped end 129*b* may also be utilized to prevent the cable from being slid through the straight channel 131. For example, the end of the cable 127 may be built-up to a larger diameter than the remainder of the cable, or may include a feature such as a ball at its end.

When the hockey puck lock 100 is not in place, the cable 127 may be nested in the straight channel 120 shown. When the hockey puck lock 100 is in place, the cable 127 is restrained and secured, but may still be able to be slid partially in and out of the link 106*c*, along straight channel 120. The hockey puck lock may simply prevent the cable 127 from being lifted off the link 106*c*.

However, a ratchet device 122 may be provided within the link 106*c* such that once the cable 127 is nested in the straight channel 120, the cable may be cinched up to remove unwanted slack. The cable 127 may be cinched up before or after the hockey puck lock 100 is in place. The ratchet device 122 may be designed such that the cable 127 may be nested into the straight channel 120 from either the direction permitted by the ratcheting deice, or from a direction above the link, perpendicular to the channel 120. However, once the hockey puck lock 100 is in place, the ratchet device 122 may only permit cable movement in one direction. In this regard, the ratchet device 122 may include teeth and may be spring loaded to facilitate only one way motion of the cable 127. The ratcheting device 122 may also include a ratchet-override feature to permit the cable to be moved in a direction otherwise prevented by the ratchet device. Such ratcheting devices are well known in the industry.

Because coated cable 127 is typically preferred, it is generally preferred that the ratchet device 122 be arranged such that it does not mar the coating of the cable upon normal use.

As with the previous links shown and described, the shackle 102 of the hockey puck lock 100 may engage through channel 101 extending through a post 114 protruding from the link 106*c*.

Figure 7:
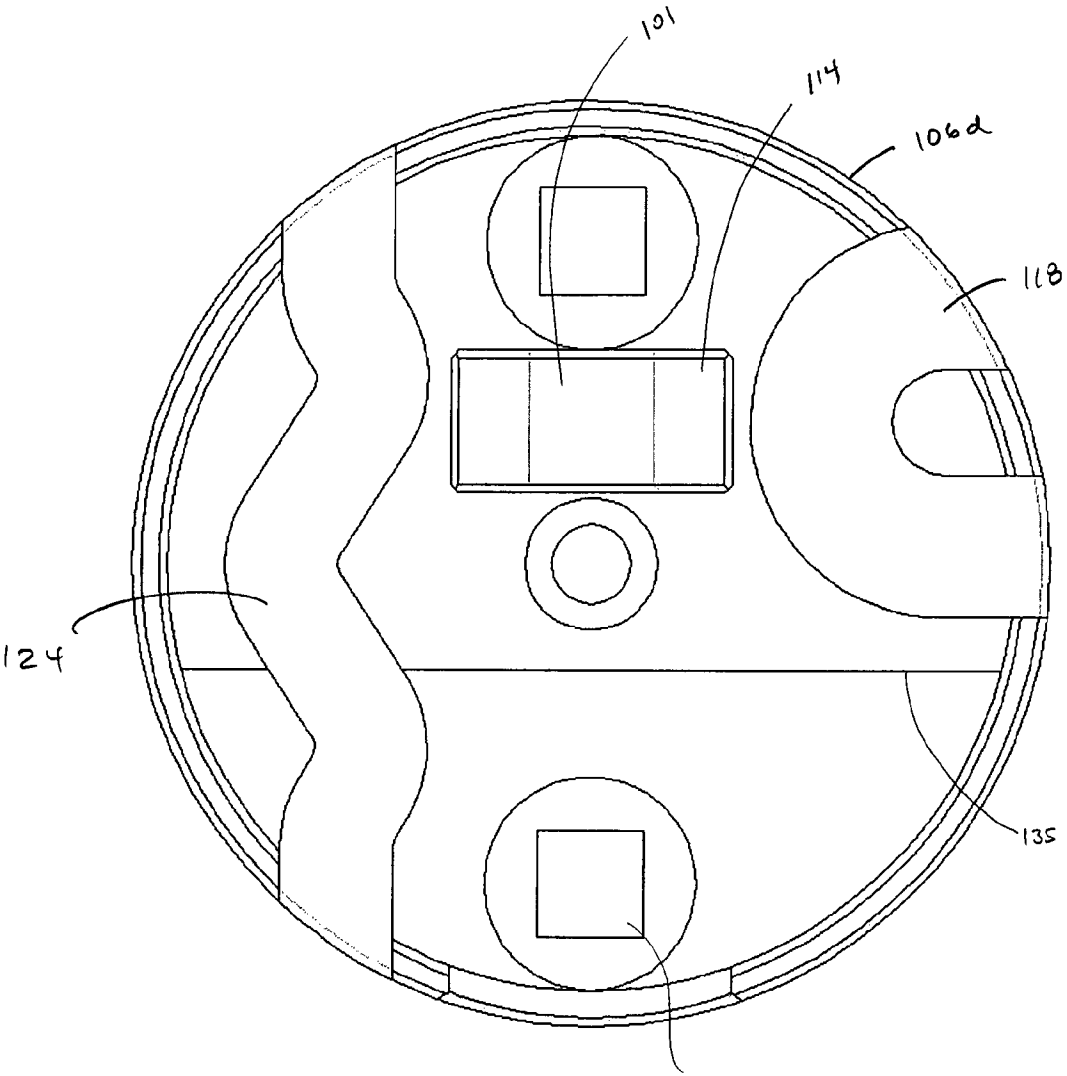
FIG. 7 depicts a top view of a link in accordance with an additional aspect of the present invention.

FIG. 7 depicts a top view of a link 106d in accordance with additional aspects of the present invention. As with link 106*c*, link 106*d* is primarily intended for use with a cable. A looped end of the cable (not shown) may be nested into the arched channel 118 as previous discussed with reference to link 106*c*. When the hockey puck lock is not in place, the cable (not shown) may be pushed into the irregular channel 124 shown. This irregular channel 124 is shaped to prevent the cable from being able to move along the long axis of the channel. This may be achieved by friction fit of the cable within the channel 124. Therefore, when the hockey puck lock 100 is in place, the cable is fully constrained and secured. Again, coated cable is preferred. As with the previous links, link 106*d* may be configured with a post 114 and through channel 101 upon which a hockey puck lock 100 may attach.

Another variation of the link 106*d* is to configure a second irregular channel in place of the arched channel 118. This variation would allow the use of cable which is un-looped at both ends, thus expanding the potential uses for the device. Additionally, a link may be provided with two ratcheting devices and channels such as those shown in FIG. 6, so un-looped cable may be used at both ends. Generally, it will be appreciated that many of the features of the various links disclosed herein may be utilized in any one particular link, such that the features may be "mixed-and-matched."

Figure 15:
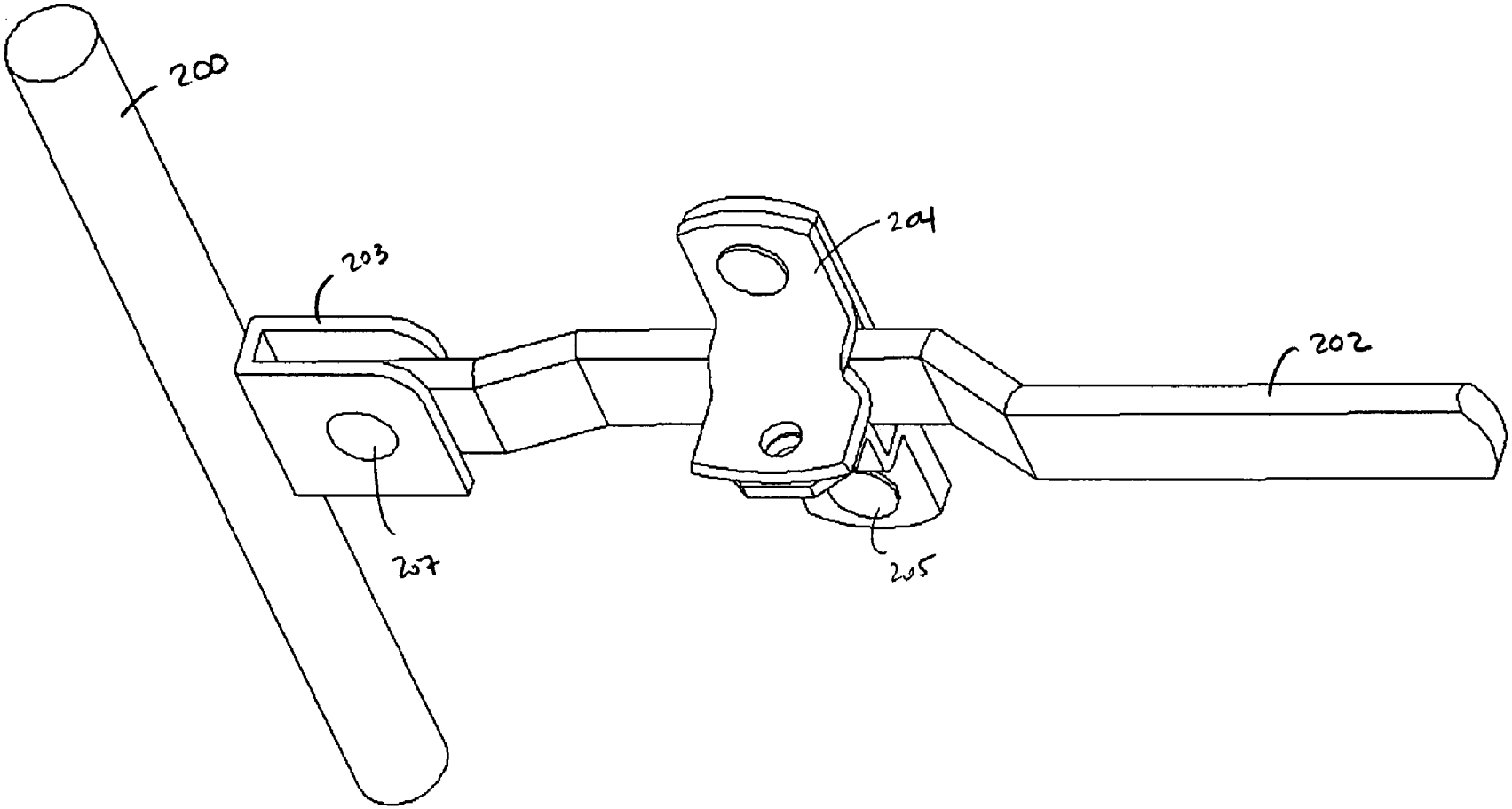

In accordance with additional aspects of the invention, a link may be configured for use with intermodal containers, trucks, rail cars, etc. It is common and well known in the industry that such containers may have a door locking arrangement that utilizes vertical lockrods connected to a lever. The vertical rods may be lifted out of their seat and rotated such that latching elements at the end of the rods are disengaged and released from their mating elements on the door frame. The typical lever arrangement is a well known weak point that is vulnerable to attack. A conventional arrangement of vertical lockrod, lever and latches is shown in FIG. 15, and is described more fully below.

Figure 8:
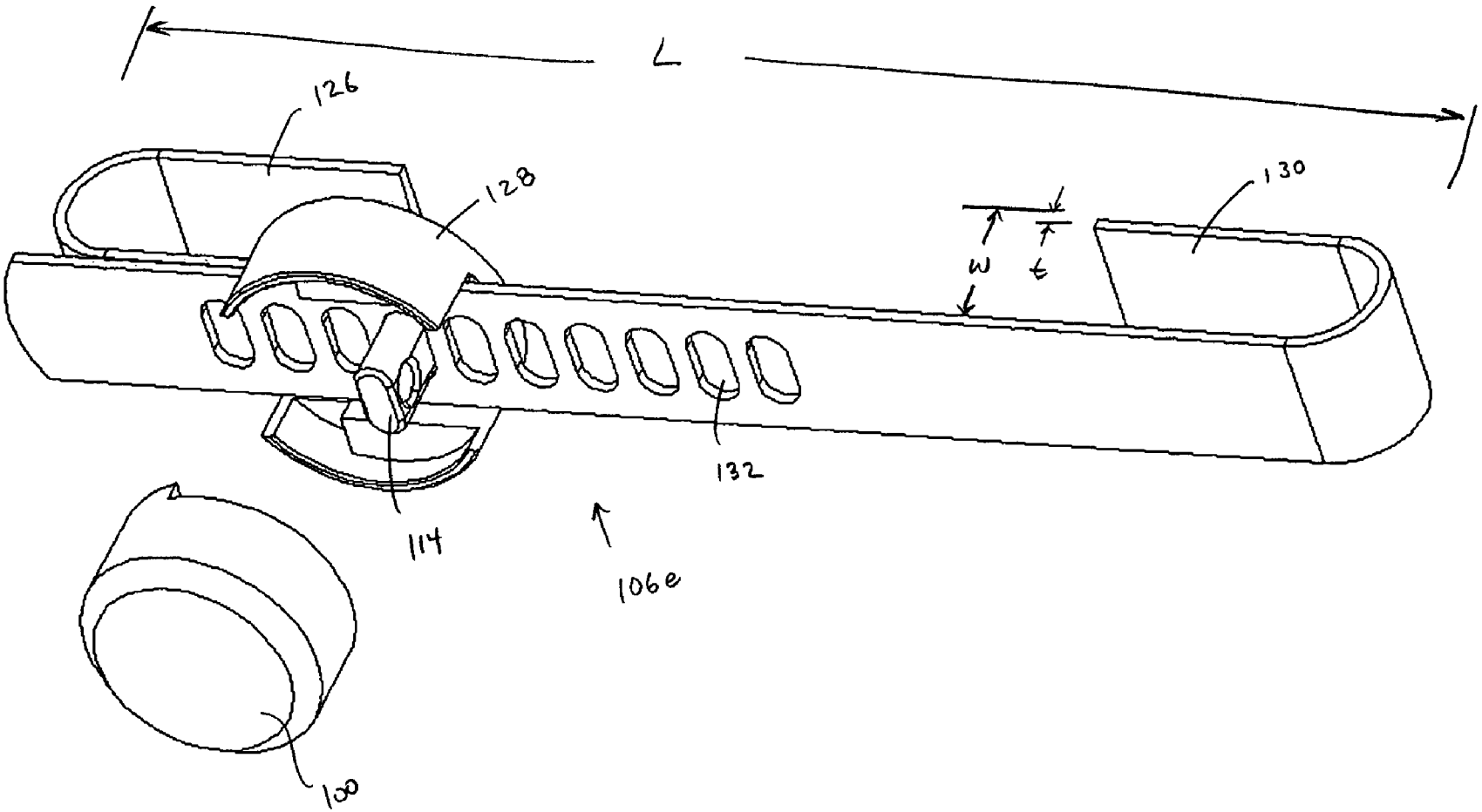
FIG. 8 depicts a perspective view of a link system in accordance with still further aspects of the present invention.

As shown in FIG. 8, link 106*e*, may be designed to fit a wide range of lockrod configurations. Variations in vertical lockrod configurations include, center to center spacing, gap between the vertical lockrod and the door face, and rod diameter. Link 106*e* is comprised of three primary elements: namely, a first hook 126 to hook around one vertical lockrod, an attachment element 128, and a second hook 130 that hooks around the other vertical lockrod. First hook 126 is preferably formed as a single structure with attachment element 128.

The link 106*e* has an array of features that allow adjustability over the typical ranges of lockrods. For example, the hooks 126, 130 are of a thickness (t) that permit them to be used where there is a narrow gap between the rods and the door face. The link 106*e* is also designed to accommodate the typical range of lockrod diameters by incorporating an oversized width (w).

The attachment element 128 is designed to receive a standard hockey puck lock to secure the hooks 126, 130 in place. Also as shown, hook 130 includes a series of apertures 132 arranged adjacent to one another along the length of the hook 130. Depending on the center to center distance of the vertical rods in which the link 106*e* is to be placed, the appropriate aperture 132 may be placed over the post 114 protruding from the attachment element 128, such that the hooks 126, 130 will be retained by the hockey puck lock 100 when installed and the overall length (L) of the link 106*e* will be appropriate for the application.

In addition, the link 106*e* shown in FIG. 8 may also be utilized with chain 103 or the like. For example, the hooks 126, 130 may be hooked around the chain and the link 106*e* locked. The hooks 126, 130 may be made long enough that so long as the chain is left taut, the chain may not be removed from the hooks. Other uses for the link 106*e* may include fence gates, such as chain link fence gates, where the hooks may be used to secure the gate from opening by attaching to the vertical fence gate supports.

Figure 9:
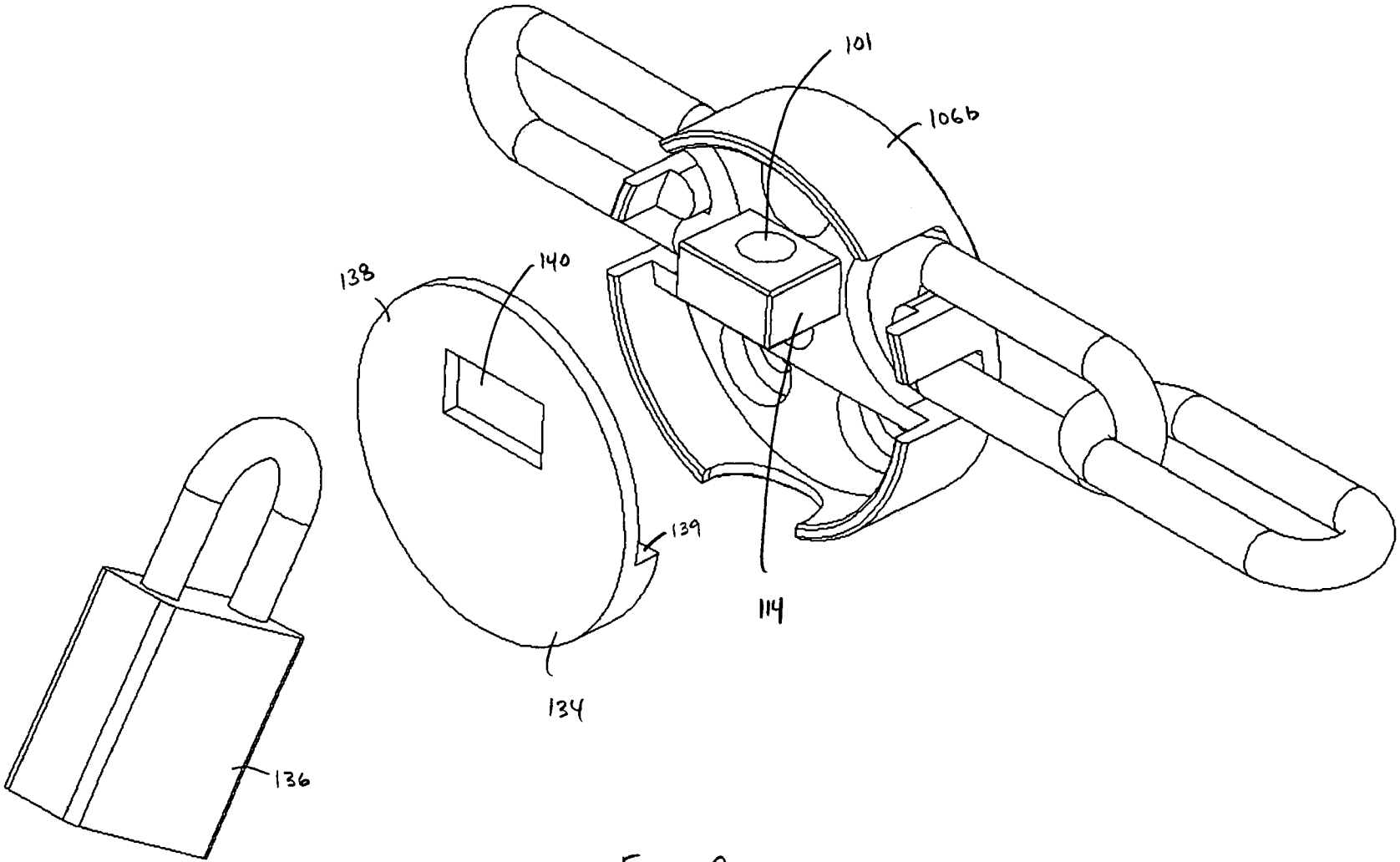
FIG. 9 depicts a perspective view of a link system in accordance with another aspect of the present invention in an unassembled condition.

In accordance with further aspects of the present invention, a link adaptor 134 may be provided for use with a link. FIG. 9 depicts a perspective view of a link system incorporating the link adapter 134 together with a link 106*b*, of the type described previously, and a conventional padlock 136. The link adapter 134 allows the conventional U-shackle padlock 136 or other padlock styles beyond that of the hockey puck locks 100 to be used with the various links of the present invention.

Figure 10:
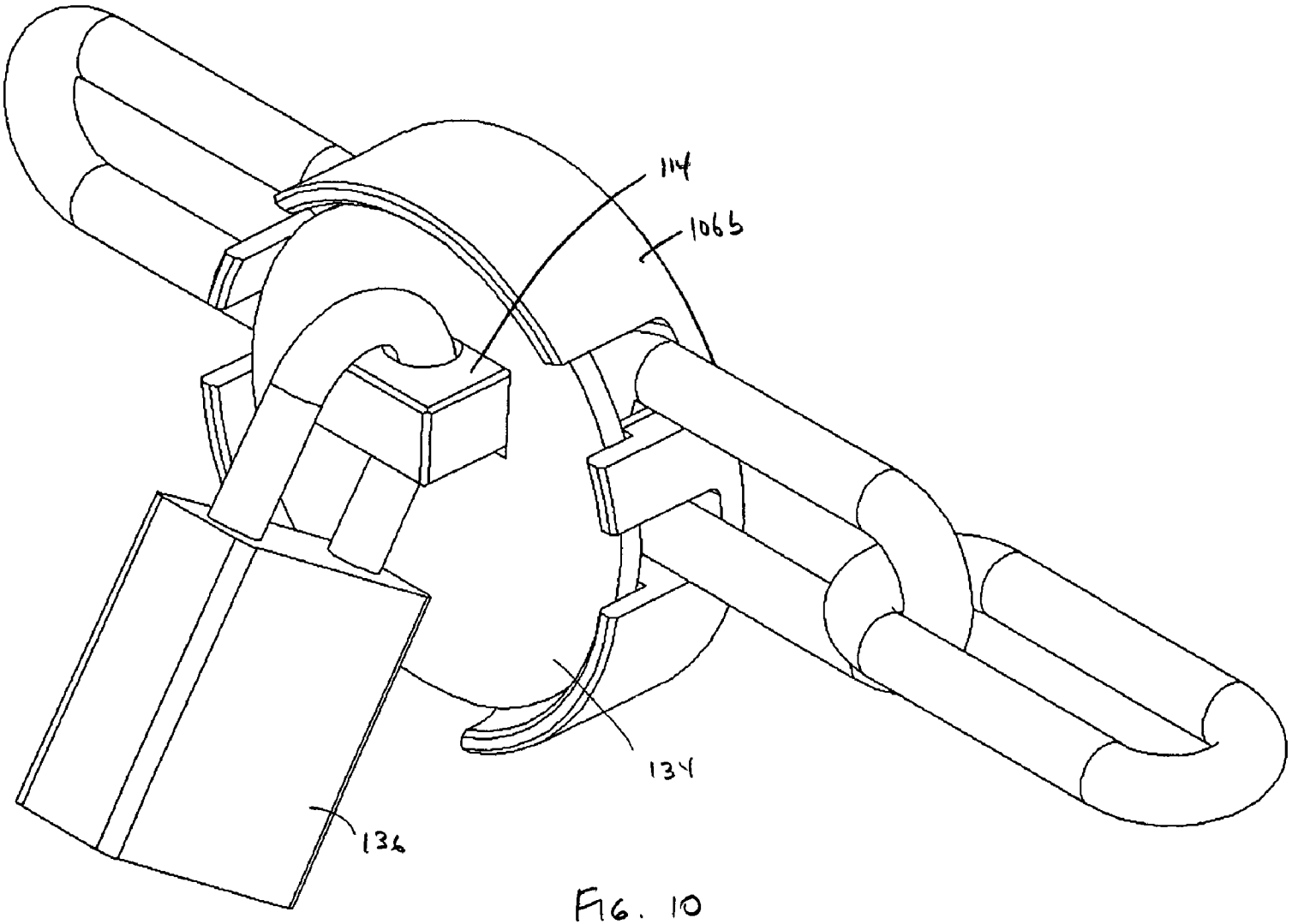
FIG. 10 depicts a perspective view of the link system of FIG. 9 in an assembled condition.

In general, the link adaptor 134 comprises a circular plate 138 with an aperture 140 therethrough. The plate 138 includes a step 139, which acts to prevent rotation of the link adaptor 134 in a similar manner as the step 104 of a conventional hockey puck lock 100. The plate 138 is configured to fit over the link 106*b*, such that the aperture 140 may fit over the post 114. The link adaptor 134, therefore, fixes the chain or cable in place, depending on the embodiment of the link 106*b*, in a similar manner as previously described with respect to the hockey puck type locks. In this regard, the plate 138 may be fairly thick, such as where the link includes ears, or thinner where posts are utilized. Once the link adaptor 134 is placed over the link 106*b*, a conventional padlock 136 may then be utilized to secure the link adaptor in place by being threaded through the through channel 101 of post 114, as shown in FIG. 10.

Figure 11:
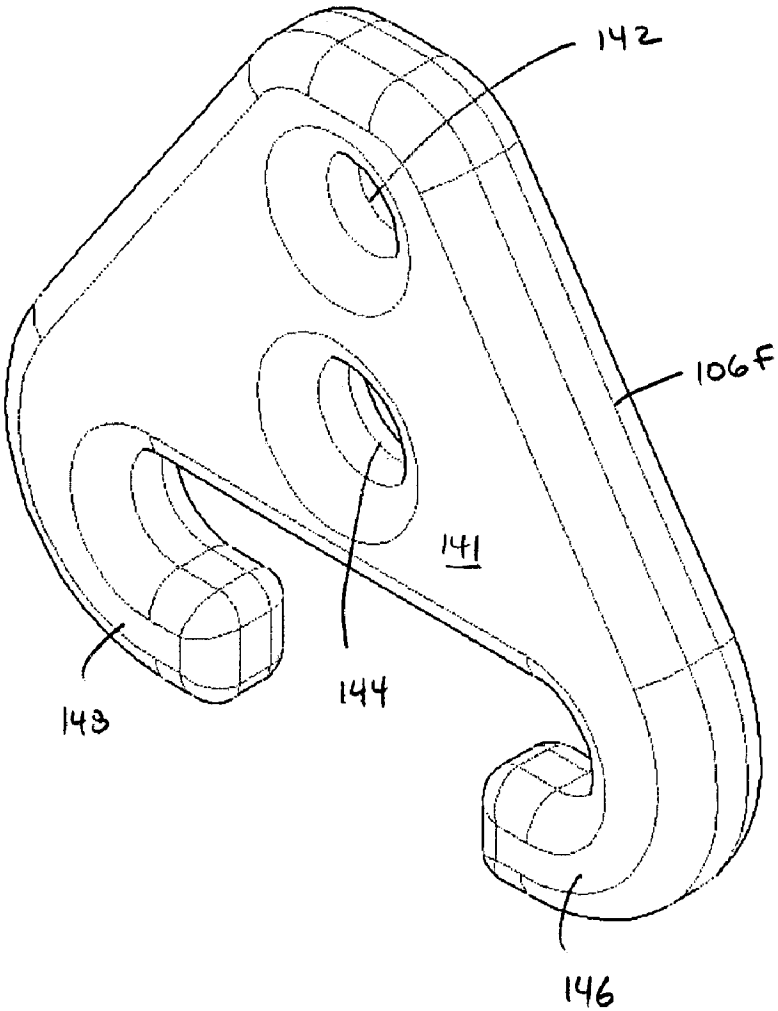
FIG. 11 depicts a perspective view of a link system in accordance with still further aspects of the present invention.

FIG. 11 depicts a perspective view of a link in accordance with yet another aspect of the present invention. As previously discussed, links are elements which allow chain or looped cable (or other securing means) to be secured using conventional padlock devices, while providing a mechanism other than a conventional lock which may sustain forces placed on the system during forced attack. Links are designed to accept common chain, cable, and lock dimensions.

Link 106*f* maintains the utility of the previous links, but in a simpler manner. In accordance with the present invention, a link 106*f*, as shown in FIG. 11, may comprise a body 141 having two through holes, referred to here as apertures 142, 144, adapted to accommodate padlocks of different sizes and configurations, such as straight shackle padlocks, circular shackle padlocks, or U-shackle padlocks. The body 141 of link 106*f* may also comprise a pair of arms 146, 148 which are adapted to thread through standard chain, looped end of cable, or the like, as will be discussed.

Link 106*f* may be machined, stamped, forged, cast, molded, etc. Materials utilized for the link 106*f* may be suitable ferrous or non-ferrous alloys or other suitable material, such as plastics. In addition, the link 106*f* may be coated for protection, such as with a plastic coating from protection from outdoor elements.

Figure 12:
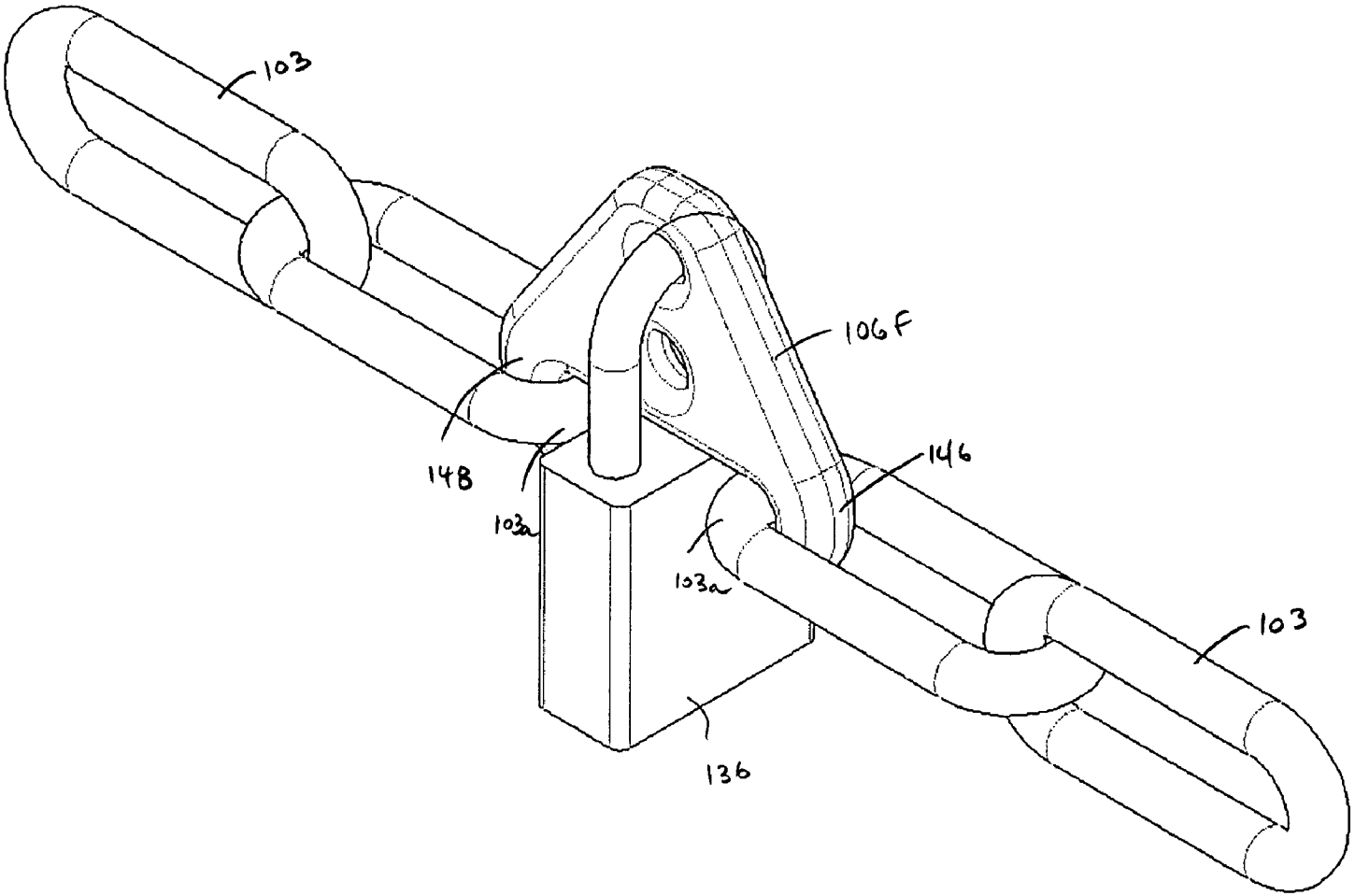
FIG. 12 depicts a perspective view of the link system of FIG. 11 in use with conventional chain and padlock.
Figure 13:
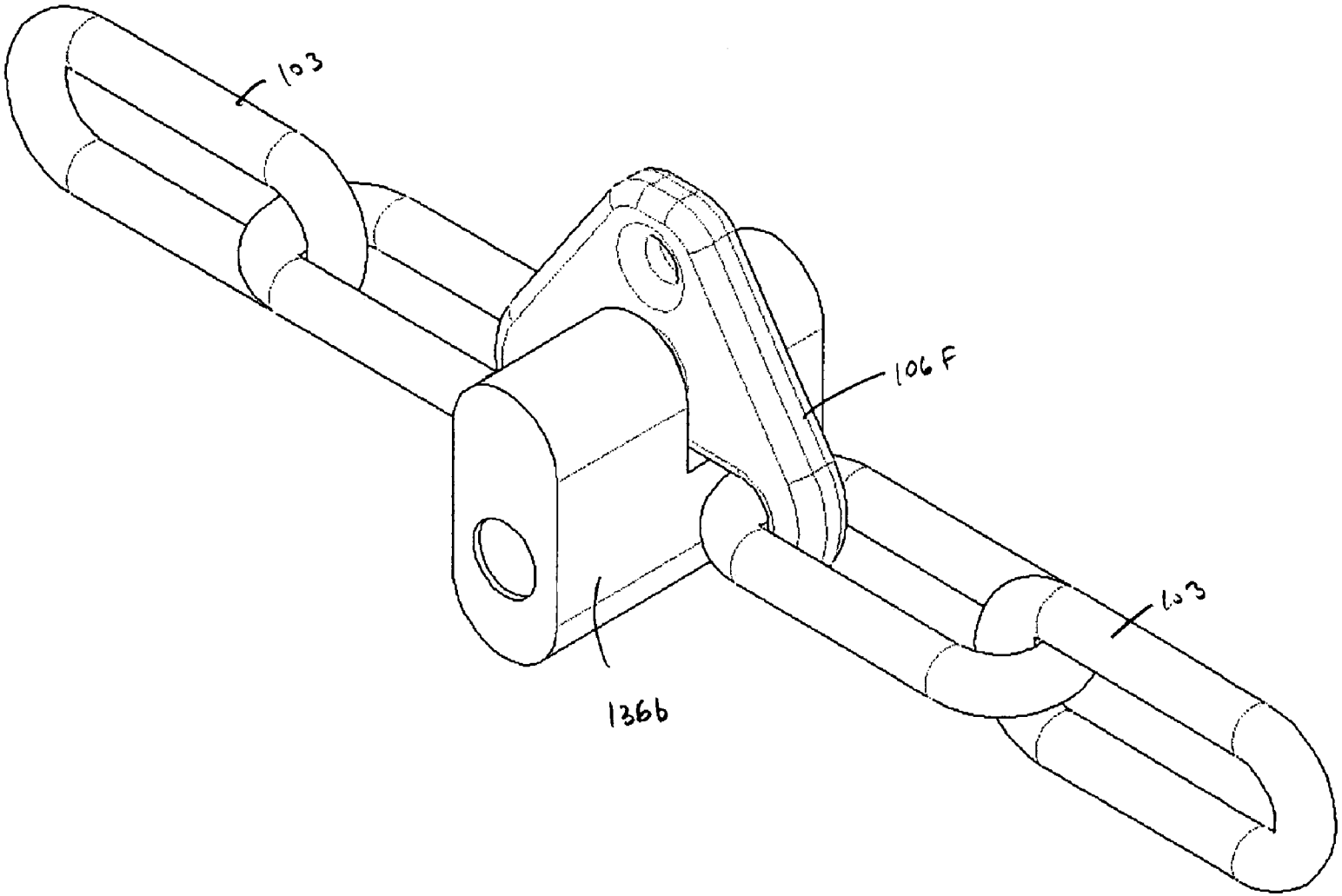
FIG. 13 depicts a perspective view of the link system of FIG. 11 in use with a conventional chain and straight-shackle lock.
Figure 14:
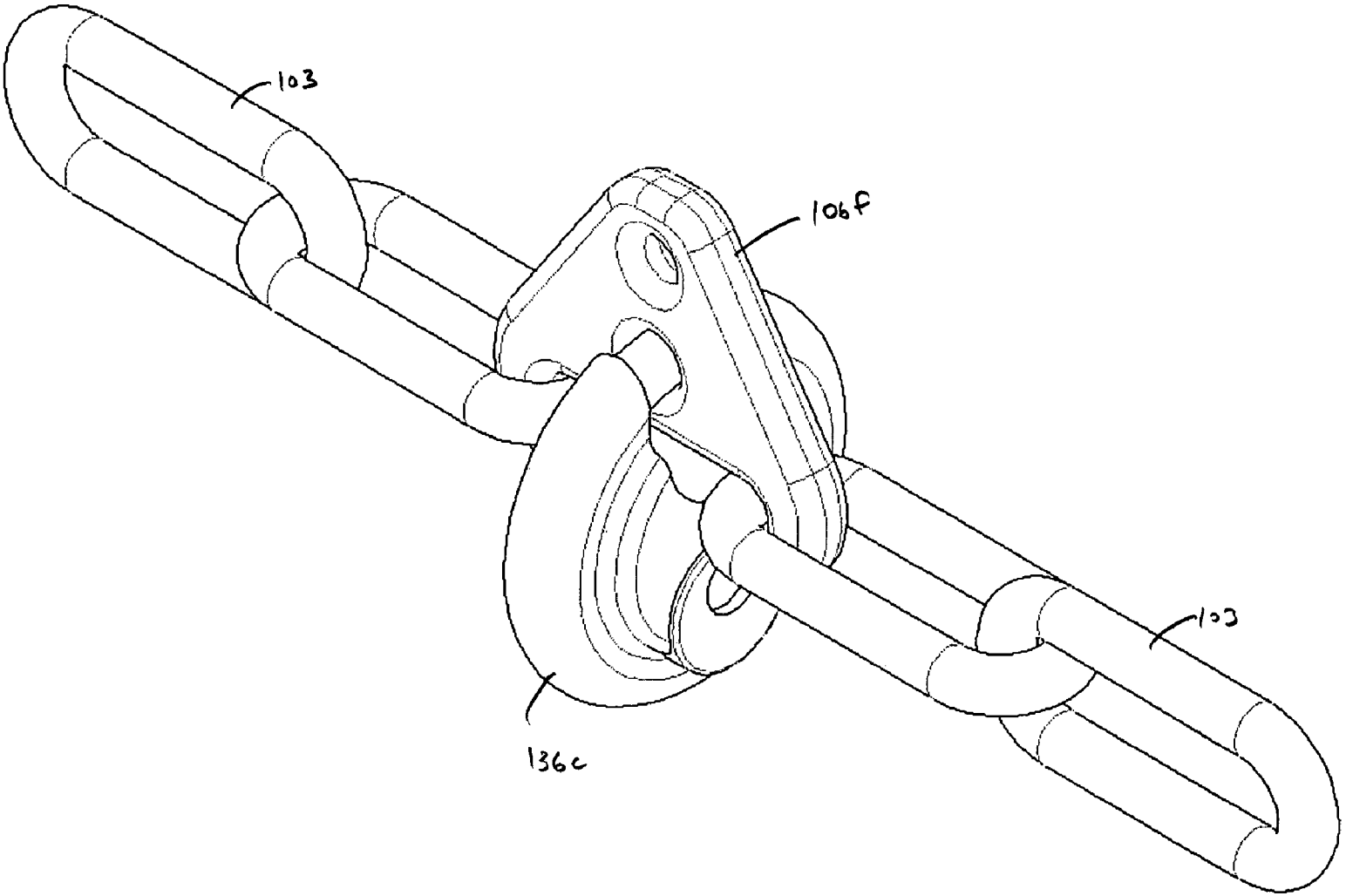
FIG. 14 depicts a perspective view of the link system of FIG. 11 in use with a conventional chain and circular shackle lock.

FIG. 12 depicts a link 106*f* in operation connecting two separate ends 103*a* of chain 103 along with a conventional padlock 136 installed for use. As shown, the link 106*f* comprises a pair of arms 146, 148 around which the respective chain ends 103*a* may be placed. The arms 146, 148 are spaced apart such that a suitable padlock 136 may then be inserted between the arms 146, 148 and chain ends 103*a*, to prevent the ends from being removed from the link 106*f*. In this regard, although it is preferred that the chain ends 103*a* abut the body of the lock 136, it will be appreciated that they need not, and it is merely sufficient that the chain end 103*a* cannot fit between the body of the lock 136 and the respective arm 146, 148. The lock shackle may then be threaded through one of the two apertures 142, 144, depending on the size of the lock, to hold the lock in place. As shown in FIGS. 14 and 15, locks of various configurations, including straight shackle 136*b* and circular shackle 136*c*, may also be utilized. In addition, it will be appreciated that the link 106*f* may include only one aperture, or more than two apertures.

As discussed with regard to other aspects of the invention, the load transferred through the chain 103 will be borne by the link 106*f*, and not by the conventional padlock 136. This novel teaching adds security to any system locked in such a manner, as the tensile strength of the link 106*f* can be made much stronger than that of the pullout strength of a conventional lock 136. Or, in the alternative, a lock 136 with a lesser pullout strength, and thus a likely less expensive lock, may be utilized with a link 106*f* to provide security levels not before capable with the simple and inexpensive lock.

In accordance with further aspects of the invention, a locking device may be incorporated for use with vertical lockrods, latch handles, and hockey puck locks, of a typical intermodal container, trailer, or the like, as discussed with respect to the aspects of the invention shown in FIG. 8 and as discussed herein. FIG. 15 depicts a conventional arrangement of a vertical lockrod 200, handle 202, and hasp mechanism 204, commonly used on intermodal containers and barn door style doors found on truck trailers, where the handle is connected to the lockrod by a hinge 203. Use of these conventional systems is well known in the industry. It is also well known that common attack points for forced entry are the rivets 205 holding the hasp mechanism 204 to the door and the rivets 207 of the hinge 205.

Figure 16:
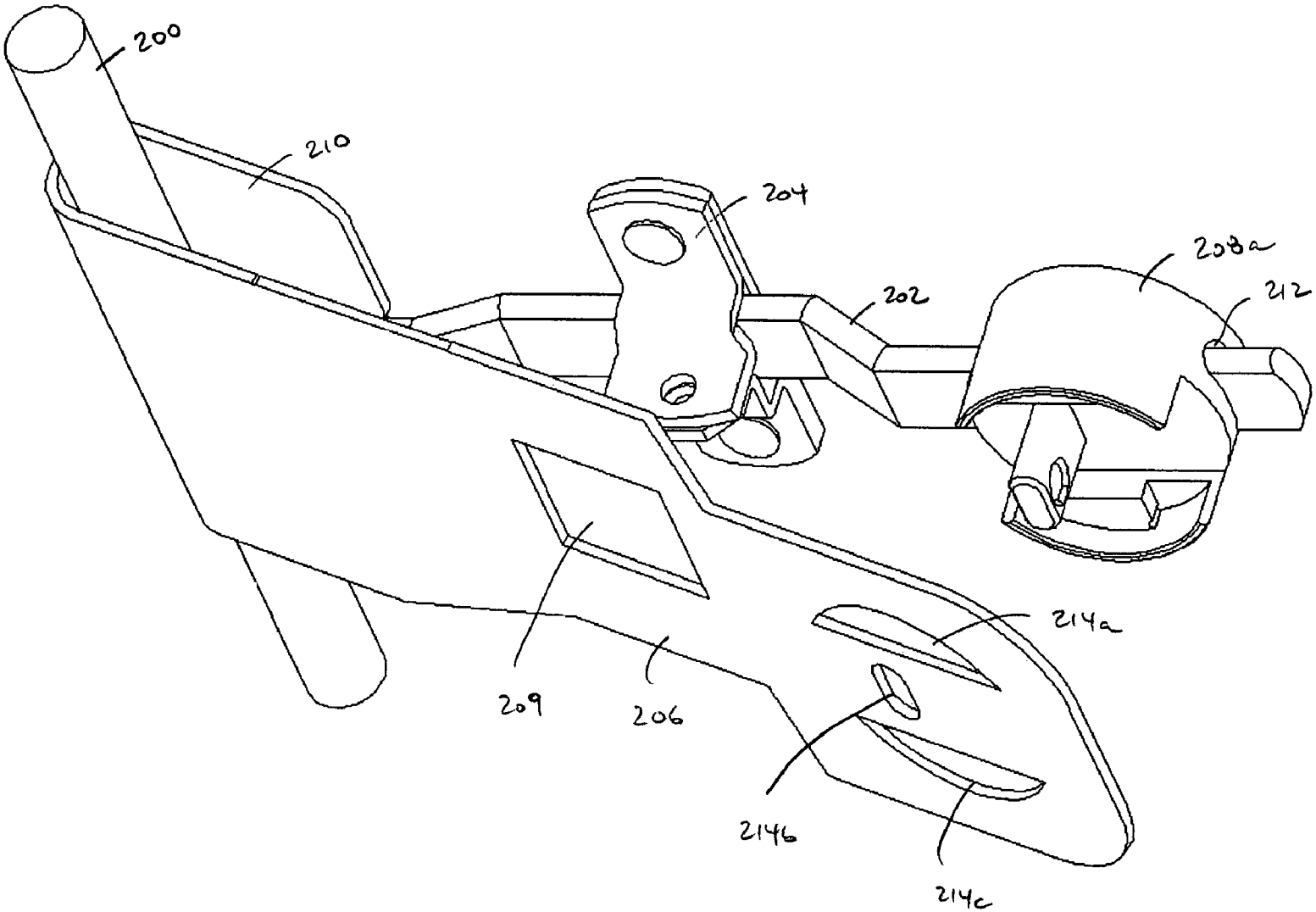
FIG. 16 depicts a frontal perspective view of a link system in accordance with further aspects of the present invention in conjunction with the conventional locking assembly shown in FIG. 15.

FIG. 16 depicts a perspective view of a security link system in accordance with further aspects of the present invention. Included in this embodiment is a strap 206 hooked around a vertical lockrod 200 and an embodiment of a security link 208*a* slipped onto the latch handle 202. The strap hook 210 is configured to allow the strap 206 to be placed onto the lockrod 200 while being capable of being swung or otherwise rotated to a position where it may engage with the security link 208*a*. The security link 208*a* has a passage 212 that permits the security link to slide along the latch handle 202 to retain adjustability along the long axis of the handle. The strap 206 may include a cutout 209 that allows portions of the hasp mechanism 204 to protrude and be used with seals and or padlocks as is conventional practice today. After the strap 206 is hooked around the vertical lockrod 200, it may be swung inward toward the container to engage or nest with the security link 208*a*, which includes portions that extend through apertures 214*a*, 214*b*, and 214*c*, extending through the strap. It will be appreciated that the strap may be configured in non-planar sections to closely align with the handle.

Figure 17:
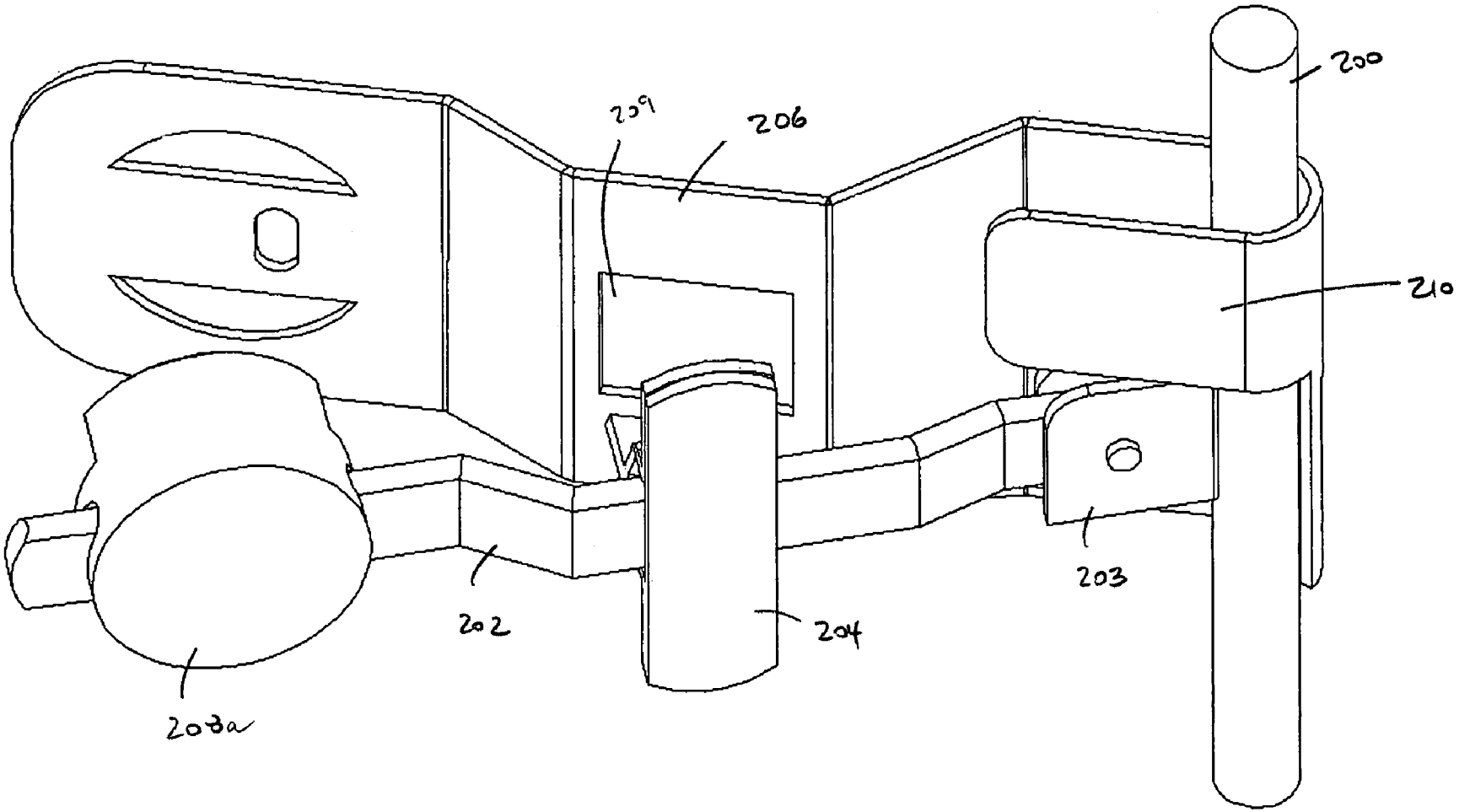
FIG. 17 depicts a rear perspective view of the link system and locking assembly shown in FIG. 16.

FIG. 17 depicts a rear view of the strap 206 showing hook element 210 in greater detail. As shown, the hook 210 may be configured to be sized smaller than the remainder of the strap 206, such that the hook will not interfere with the hinge 203.

Figure 18:
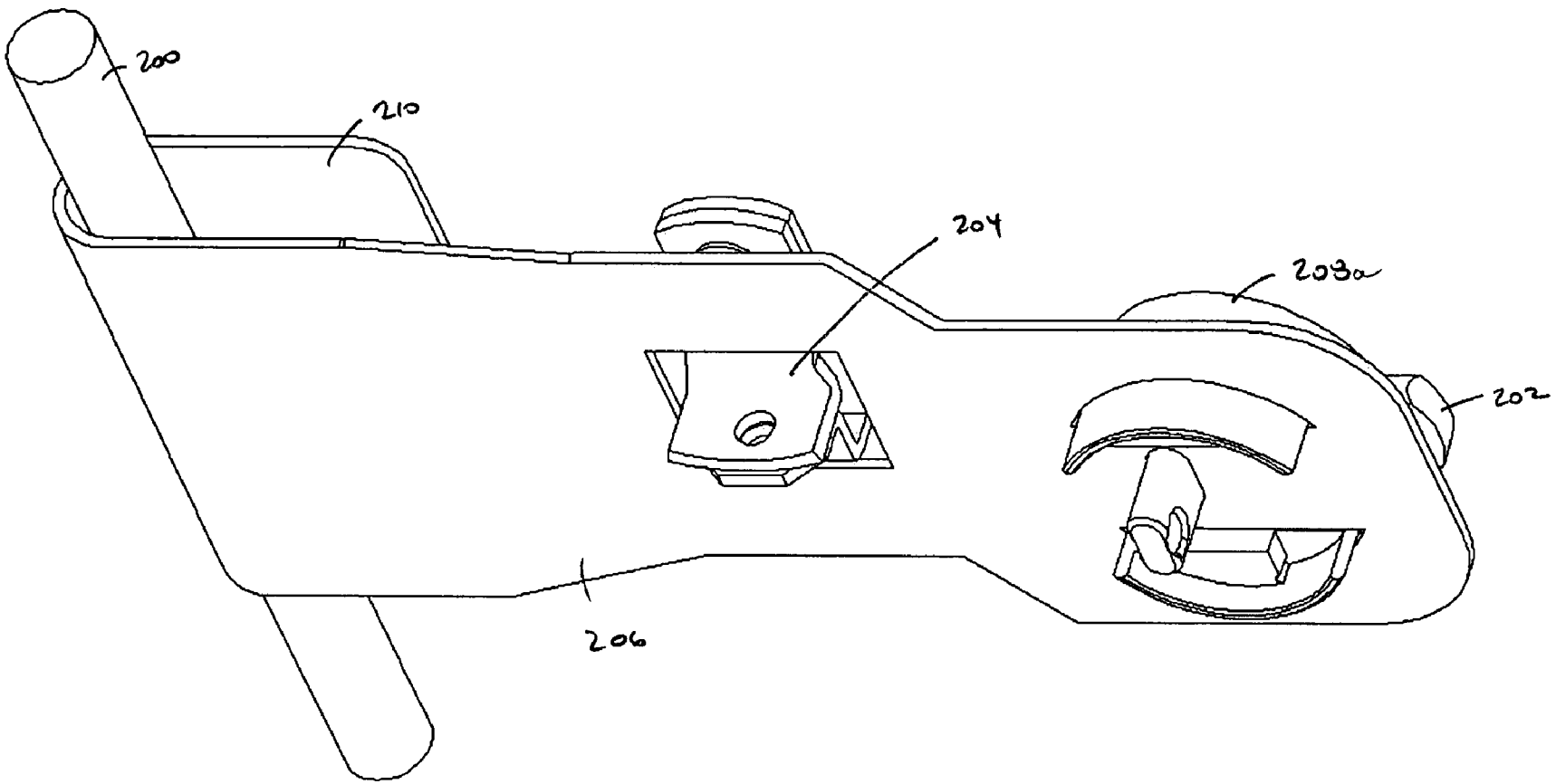
FIG. 18 depicts a frontal perspective view of the link system and locking assembly shown in FIG. 16, with the link system in a partially secured condition.

FIG. 18 depicts a perspective view of the strap 206 fully engaged/nested into the hasp mechanism 204 and the security link 208*a*.

Figure 19:
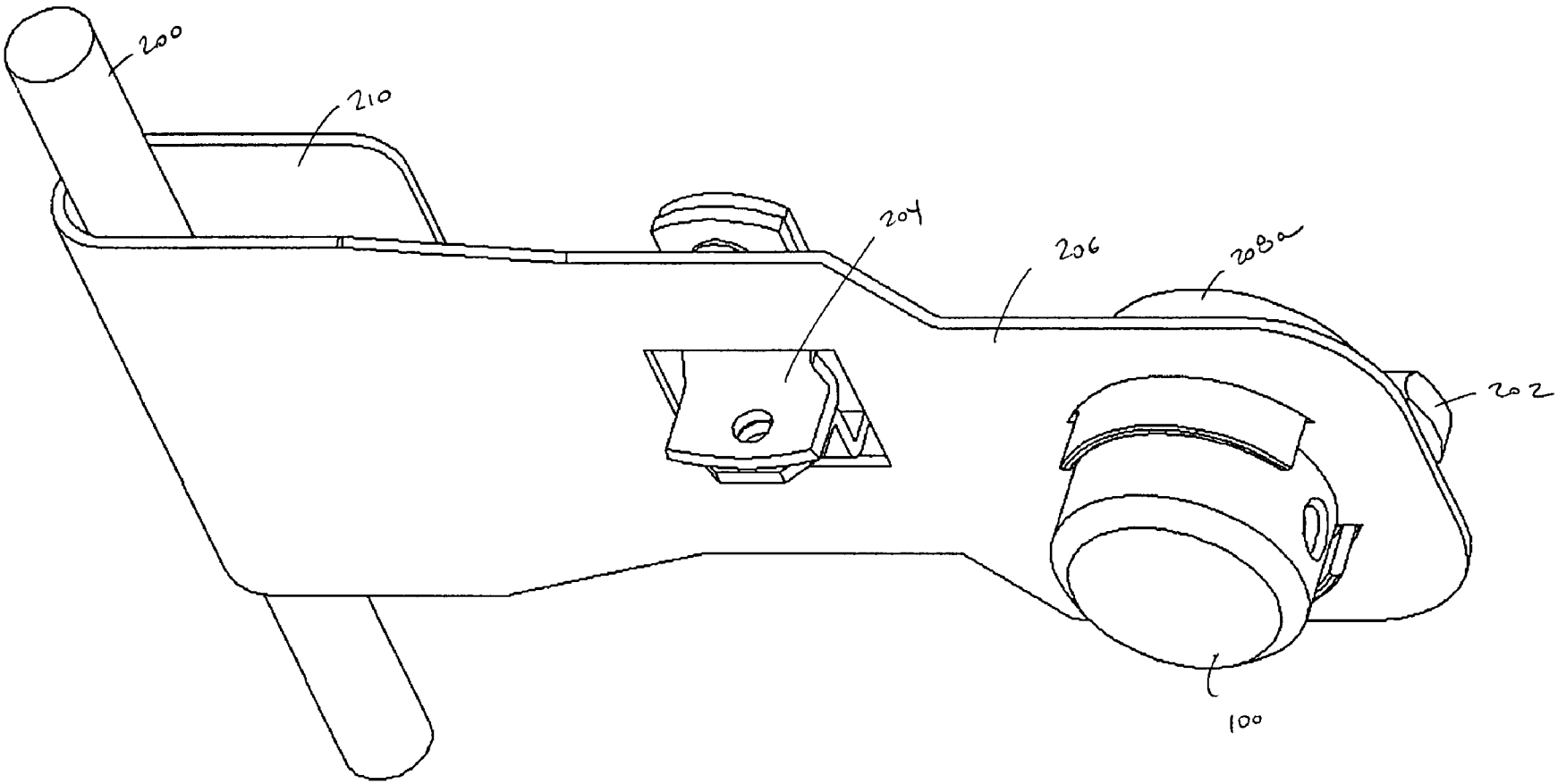
FIG. 19 depict a frontal perspective view of the link system and locking assembly shown in FIG. 18, with the link system in a fully secured condition.

FIG. 19 depicts a perspective view of the system shown in FIG. 16, along with a hockey puck lock 100 in place. As previously indicated, this is the locked condition of the system. If desired, a conventional padlock may also be utilized on the hasp 204.

Figure 20:
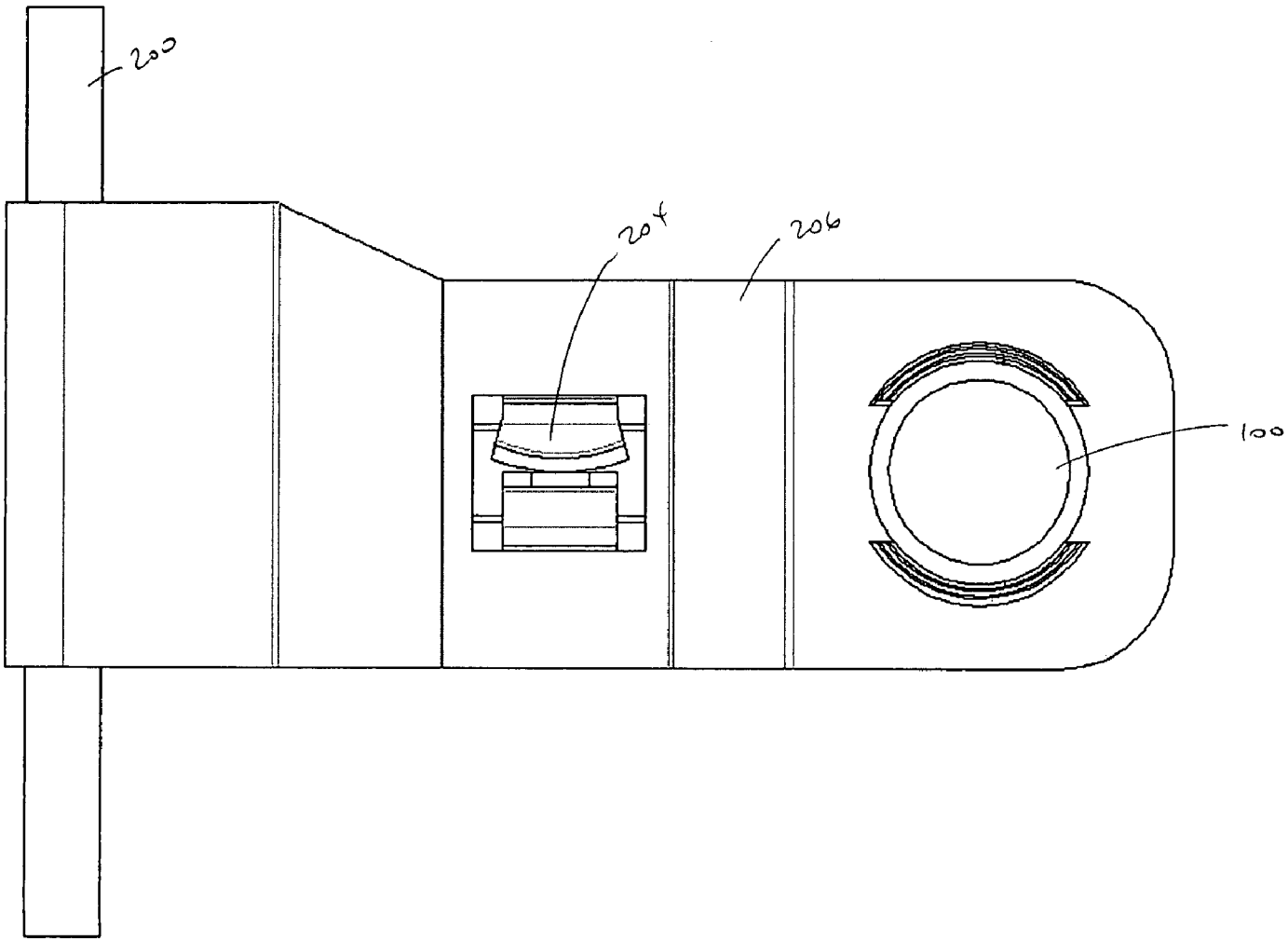
FIG. 20 depicts a frontal view of the link system and locking assembly of FIG. 19.

FIG. 20 depicts a front view of the system shown in FIG. 16.

Figure 21:
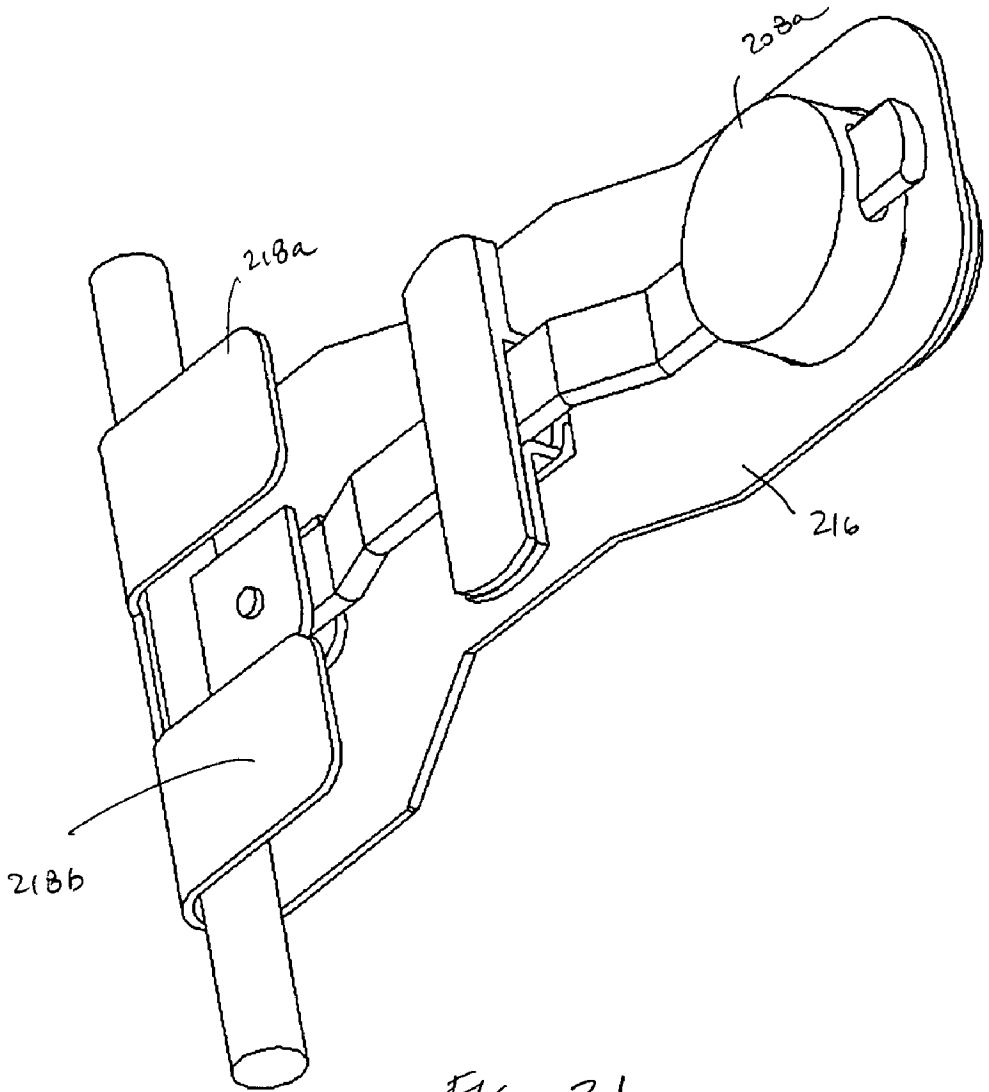
FIG. 21 depicts a rear perspective view of a link system in accordance with still further aspects of the present invention in conjunction with the conventional locking assembly shown in FIG. 15.

FIG. 21 depicts a rear perspective view of strap 216 in accordance with a further aspect of the present invention, wherein the strap includes two hook tabs 218*a*, 218*b*. Strap 216 otherwise may be operable in the same manner as strap 206, discussed previously.

Figure 22:
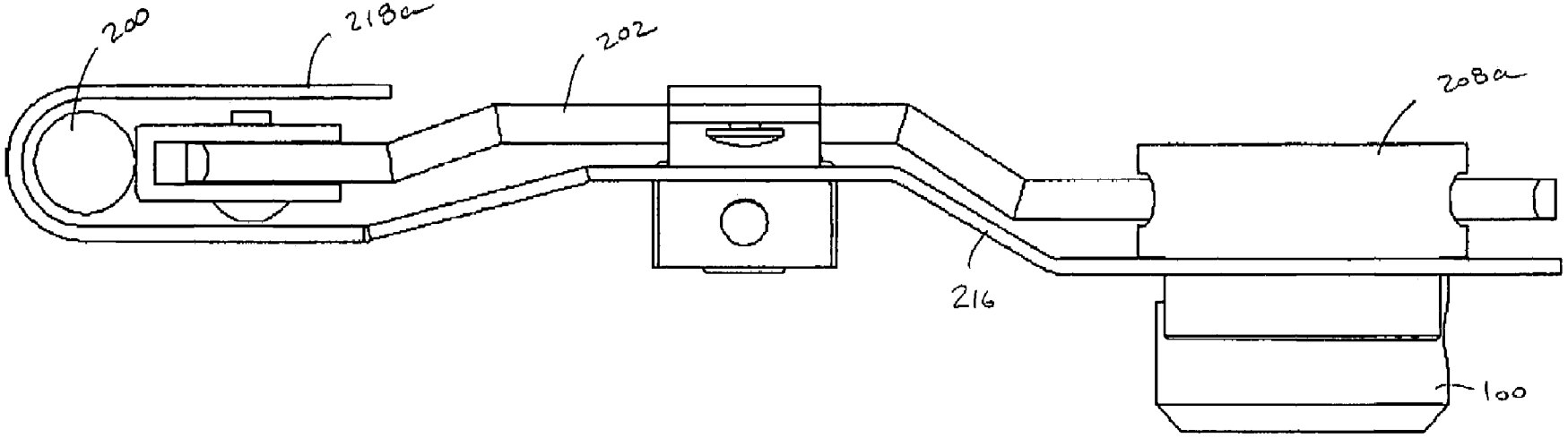
FIG. 22 depicts a top view of the link system and locking assembly shown in FIG. 21.

FIG. 22 depicts a top view of the strap assembly shown in FIG. 21, with a hockey puck lock installed. It will be noted that in the previous aspects of the invention, the straps have provisions such that the hasp 204 is permitted to penetrate through the strap, such that it may be used. Even so, it is preferred that the rivets 205 securing the hasp to the door remain covered. In this manner, the rivets are then difficult for the malfeasant to attack. Similarly, it is preferred that the rivet 207 forming a portion of the hinge 203 also be protected. In accordance with further aspects of the present invention, as shown in FIG. 23, additional safety features may be incorporated.

Figure 23:
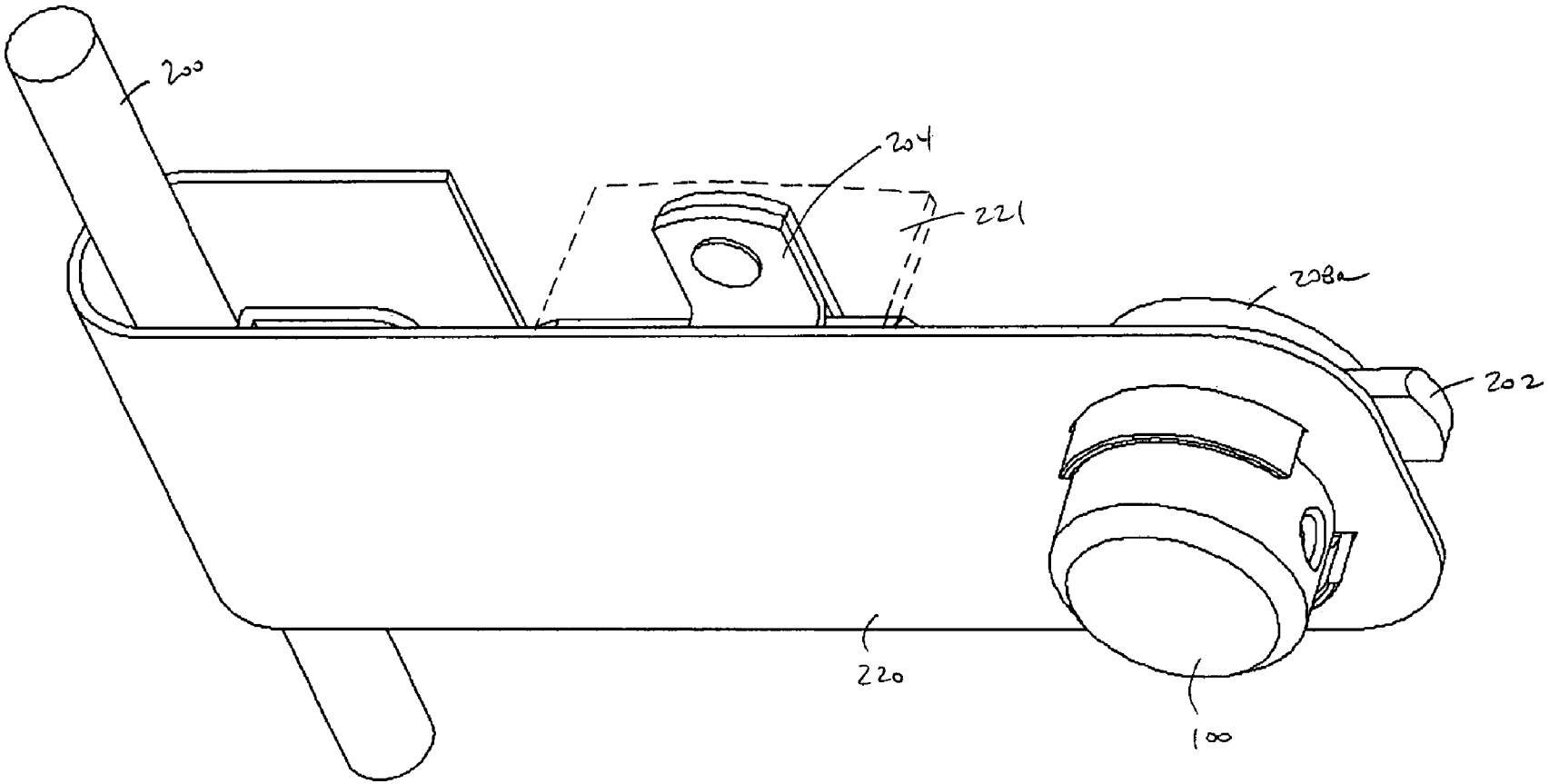
FIG. 23 depicts a perspective view of a link system in accordance with additional aspects of the present invention in conjunction with the conventional locking assembly shown in FIG. 15.

FIG. 23 depicts a perspective view of a further aspect of a strap in accordance with the present invention. In this aspect, a strap 220 does not have a cutout for the hasp assembly 204. The hasp assembly 204 is therefore completely covered and protected when the strap 220 is closed and the conventional hockey puck lock 100 is in place. In this regard, the strap may include additional extensions 221 (shown in dashed form for clarity) which may completely cover the hasp 204.

Figure 24:
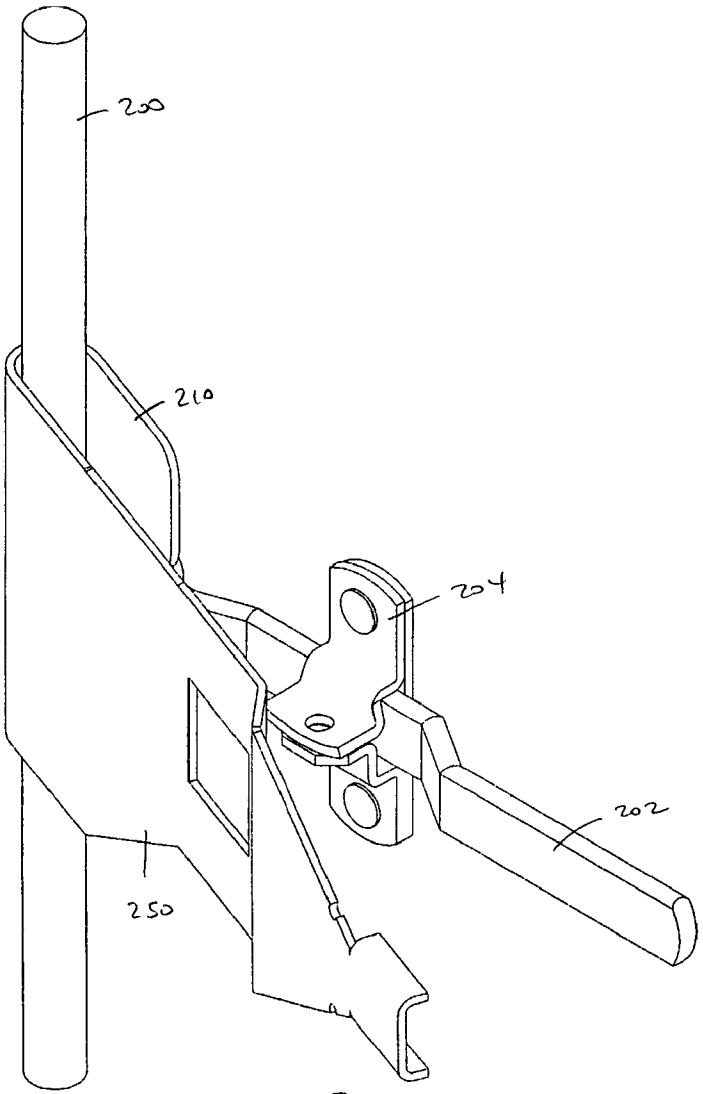
FIG. 24 depicts a perspective view of portions a link system in accordance with a still further aspect of the present invention, in a partially installed position.

FIG. 24 depicts a strap 250 in accordance with a further aspect of the present invention. In this aspect, the strap 250 may be constructed with less material, to save cost and weight. The strap 250 may be similar to the previous straps discussed, including the provision of strap hook 210. As shown in FIG. 24, strap hook 210 may be secured around the vertical support 200 of a conventional intermodal container type lock mechanism. The strap may then be swung inward, toward the door, into the position shown in FIG. 25. It is there more clearly shown that the strap 250 may include a tapered section 252 culminating at a distal end 254 with a squared section 256. The squared section may include extensions 258 to partially encircle the handle 202.

Figure 25:
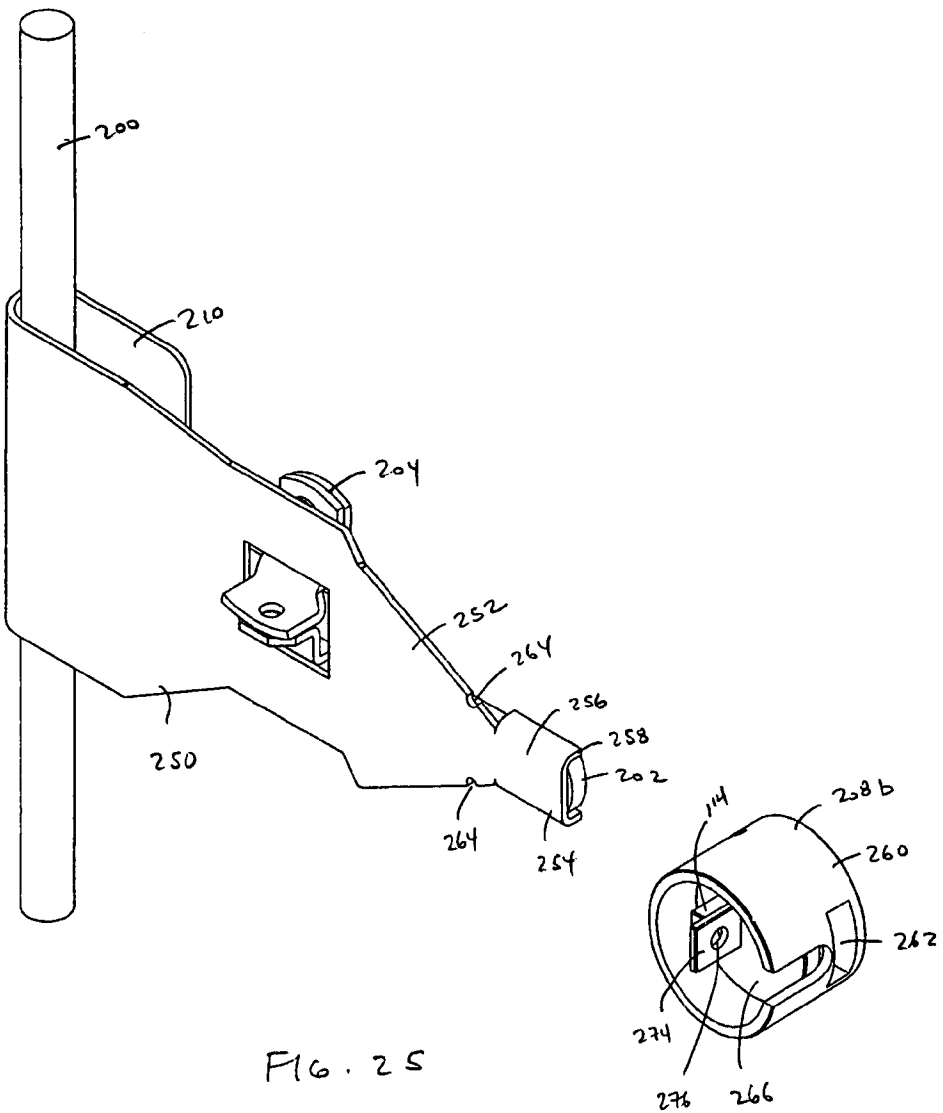
FIG. 25 depicts a perspective view of portions of the link system of FIG. 24 in a more fully installed position.
Figure 26:
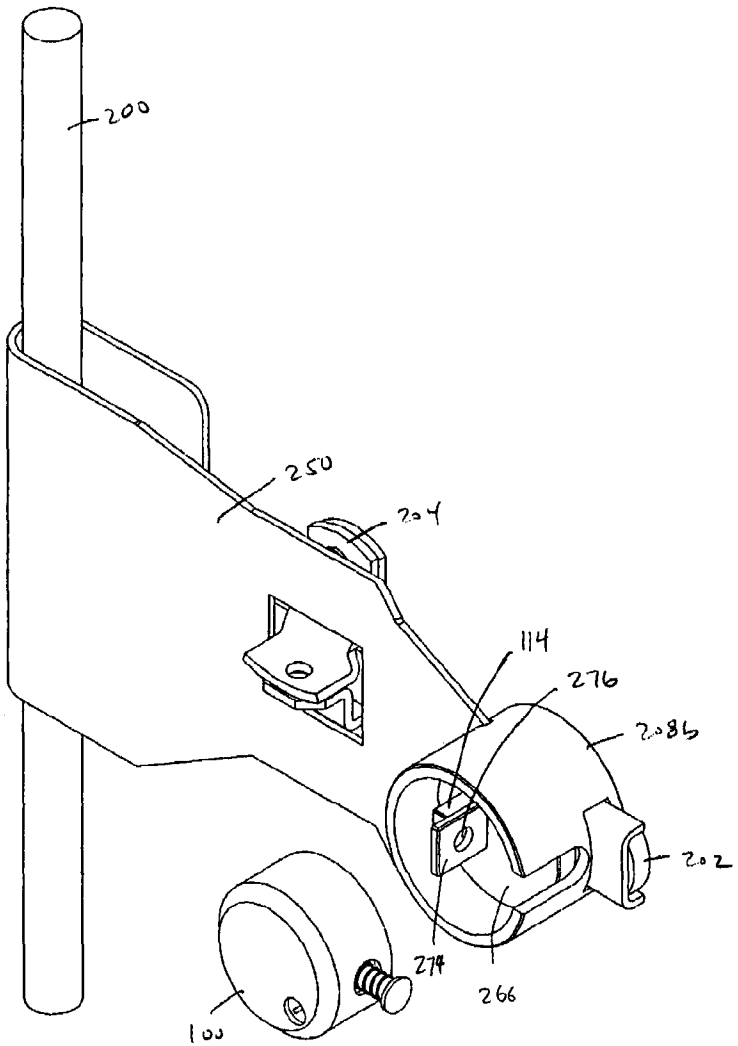
FIG. 26 depicts a perspective view of portions of the link system of FIG. 25 in a still more fully installed position.

Also shown in FIG. 25 is a link 208*b*. Link 208*b* is similar to link 208*a*, except link 208*b* includes a deeper base section 260 with an aperture 262. The aperture 262 is sized and configured to accept the distal end of the strap 250 and the handle 202, as shown in FIG. 26.

Also shown in FIG. 25, it will be appreciated that the strap 250 includes notches 264 in its tapered section 252. The notches, as will be discussed, help to prevent the hockey puck lock 100 and link 208*b* from being slid off the handle 202, when the hockey puck lock is installed.

Figure 27:
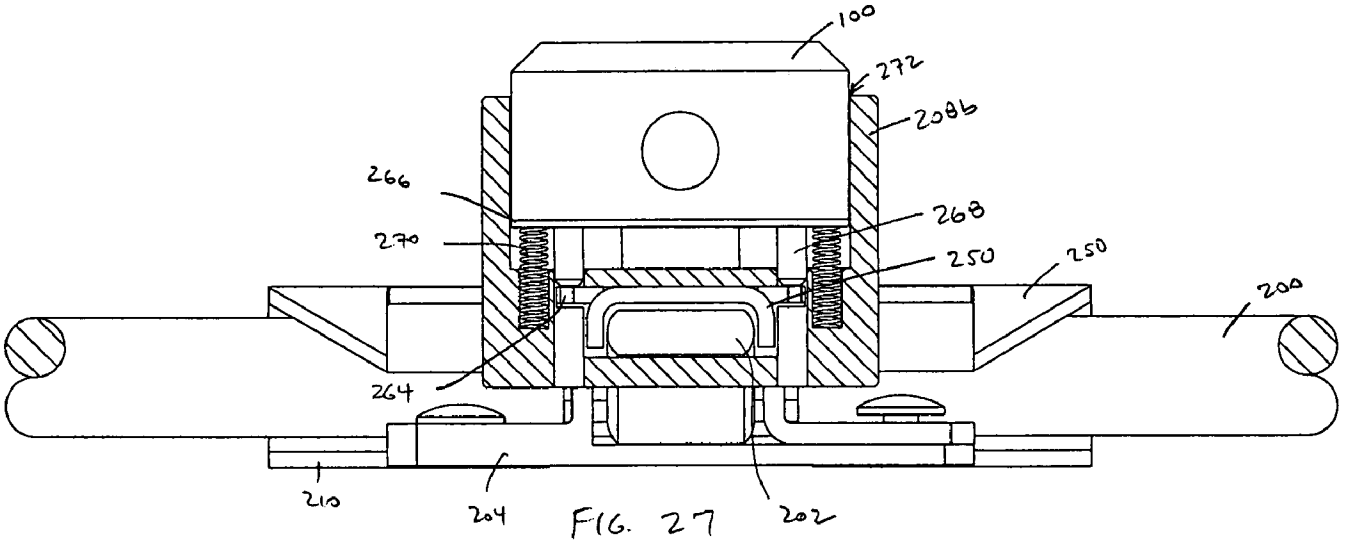
FIG. 27 depicts a cross section the link system of FIG. 24 in a nearly installed position.

In this regard, the link 208*b* may be provided with a moveable plate 266. The plate 266 may include the post 114 on one side that the hockey puck lock 100 attaches to, and pins 268 (FIG. 27) on the other. The pins 268 associate with the notches 264 to prevent the link 208*b* from being slid off the handle when the hockey puck lock is installed. FIG. 26 depicts a perspective view of a link 208*b* installed on the strap 250. FIG. 27 depicts a cross section of this arrangement. As shown in FIG. 27, springs 270 may serve to push plate 266 up toward the open end 272 of link 208*b*. In this position, it is shown that the pins 268 are clear of the notches 264, such that the link 208*b* may freely slide along the squared section 256 of the strap 250. Once in this position, the hockey puck lock 100 may be lowered, compressing springs 270, and pushing pins 268 into notches 264.

Figure 28:
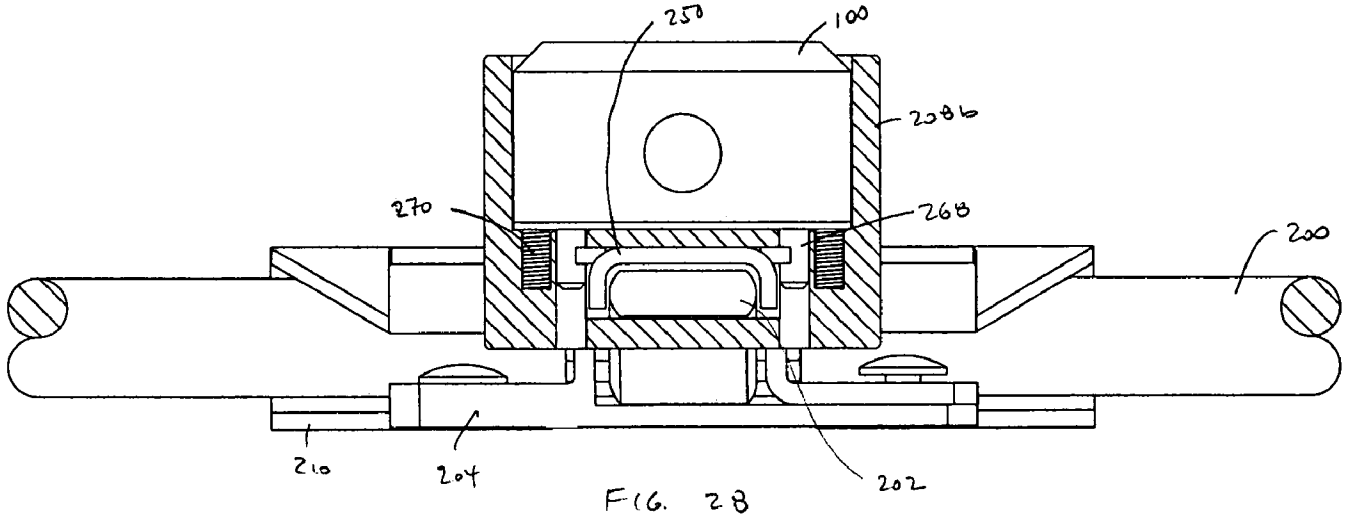
FIG. 28 depicts a cross section of the link system of FIG. 24 in a fully installed position; and, FIG. 29 depicts a perspective view of the link system of FIG. 24 in a fully installed position.
Figure 29:
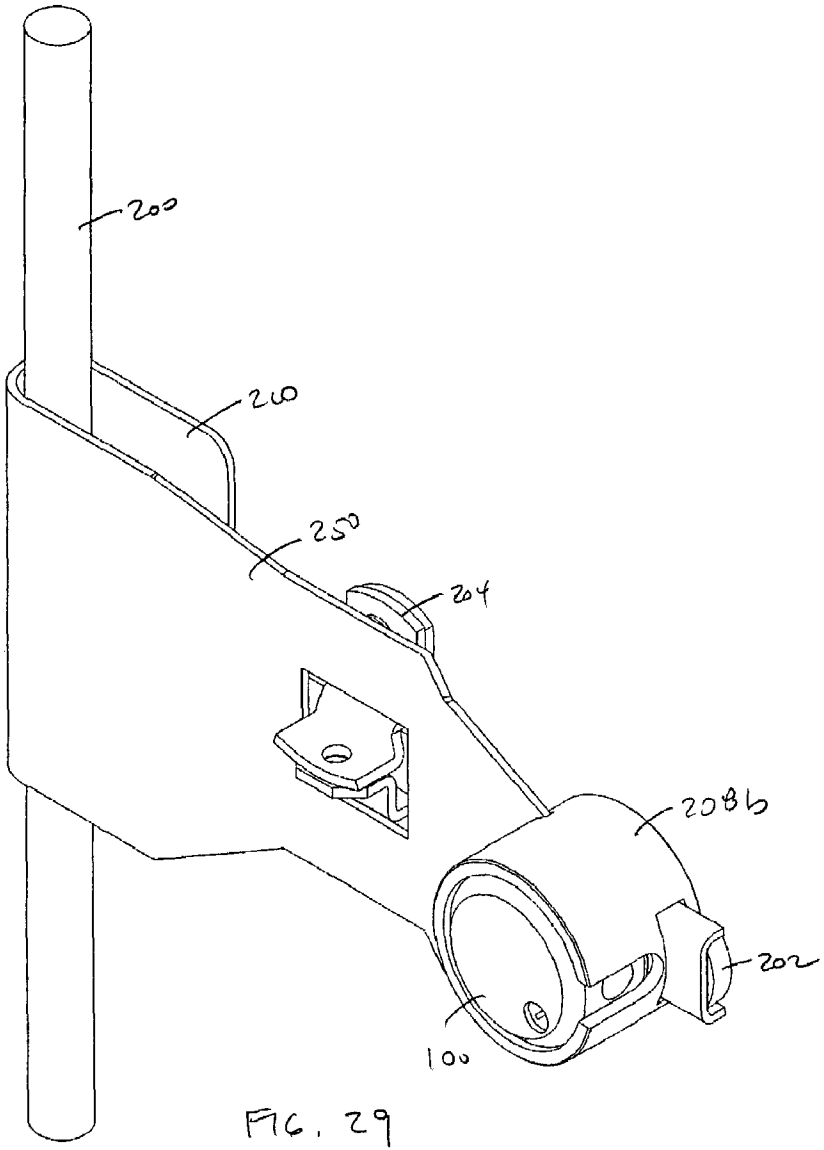

To maintain the hockey puck lock 100 in this lowered position, the plate 266 may include a post 274 extending adjacent to the post 114 associated with the link 208*b*, and permitted to penetrate the plate. The post 274 may include an aperture 276 which aligns with through channel 101 when the hockey puck lock 100 is pressed into the link 208*b*, such as shown in FIG. 28. The shackle of the hockey puck lock 100 may then be threaded through the through channel 101 of post 114 as well as the aperture 276 of post 274. FIG. 29 depicts a link 208*b* with strap 250 in the fully installed position.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A link for connecting at least one securing member with a locking device having a body and a shackle, said link comprising:

a raised outer lip defining an internal volume, a first securing element adapted to receive a first securing member, and a post with a through hole, the post adapted to receive the shackle of a locking device;

wherein said through hole and said first securing element are arranged so that when the shackle of the locking device is inserted through said through hole, the body of the locking device is arranged to block the first securing member from being separated from said securing element;

a second securing element, said second securing element adapted to receive a second securing member, and wherein said through hole and said second securing element are arranged such that when the shackle of the locking device is inserted through said through hole, the locking device is arranged to block said second securing member from being separated from said second securing element.

2. The link of claim 1, wherein the locking device is arranged at least partially within said internal volume of said raised outer lip when the shackle of the locking device is inserted through said through hole.

3. The link of claim 1, wherein said first securing member and said second securing member are portions of a common securing member device.

4. The link of claim 1, wherein said first securing element is one of an ear or a post.

5. The link of claim 4, wherein said securing element is an ear and said ear is one of C-shaped, J-shaped, or U-shaped.

6. The link of claim 4, wherein said securing element is an ear and said ear includes an end adapted to be located in close proximity to the body of the locking device when the shackle of the locking device is inserted through said through hole to prevent the first securing member from being unsecured through a gap created between said securing element and the body of the locking device.

7. The link of claim 4, wherein the securing element is a post and the locking device is adapted to rest atop a portion of said post to block the first securing member from being unsecured when the shackle of the locking device is inserted through said through hole.

8. The link of claim 1, wherein said raised outer lip is interrupted by said first securing element.

9. The link of claim 1, wherein the locking device is a hidden shackle style locking device.

10. The link of claim 1, further comprising at least one mounting hole through said link to permit mounting of said link to an object.

11. The link of claim 1, wherein first securing element is a post having a stepped portion.

12. The link of claim 1, wherein said link forms an anti-rotation step to prevent rotation of the locking device.

13. The link of claim 1, further comprising, a recess adjacent to said first securing element, said recess adapted to accept a portion of the first securing member.

14. The link of claim 1, wherein said raised outer lip is circular.

15. The link of claim 1, wherein said raised outer lip is discontinuous.

16. The link of claim 1, wherein said internal volume of said raised outer lip is substantially cylindrical.

17. A link for connecting a first and a second member with a locking device having a body and a shackle, said link comprising:

a raised outer lip defining an internal volume, a first securing element adapted to receive the first member, and a post with a through hole located in the internal volume, the post adapted to receive the shackle of the locking device;

wherein said through hole and said first securing element are arranged so that when the shackle of the locking device is inserted through said through hole, the body of the locking device is arranged to block the first member from being separated from said first securing element, a channel adapted to receive the second member, wherein said channel includes a ratcheting device adapted to permit said second securing member to move through said channel in only one directiow; and wherein the raised outer lip, the first securing element, the post with a through hole and the channel are integrally formed.

18. A link for connecting at least one securing member with a locking device having a body and a shackle, said link comprising:

a base having a raised outer lip defining an internal volume, a first securing element adapted to receive a first securing member, and a post with a through hole, the post adapted to receive the shackle of a locking device;

wherein said through hole of said base and said first securing element of said base are arranged so that when the shackle of the locking device is inserted through said through hole of said base, the body of the locking device is arranged to block the first securing member from being separated from said securing element;

further comprising a channel adapted to receive a second securing member; wherein said channel includes a ratcheting device adapted to permit said second securing member to move through said channel in only one direction.

19. A link for connecting a first secured member and a second secured member with a locking device having a body and a shackle, comprising:

a raised outer lip defining an internal volume, a first securing element adapted to receive the first secured member, a second securing element adapted to receive the second secured member and a post with a through hole, the post adapted to receive the shackle of the locking device;

wherein the through hole and the first securing element are arranged so that when the shackle of the locking device is inserted through the through hole, the body of the locking device blocks the first secured member from being separated from the first securing element;

wherein the through hole and the second securing element are arranged so that when the shackle of the locking device is inserted through the through hole, the body of the locking device blocks the second secured member from being separated from the second securing element.

20. The link of claim 19, further comprising a first channel to receive the first securing member and a second channel to receive the second securing member.

* * * * *